US007510177B2

(12) United States Patent
Nagata et al.

(10) Patent No.: US 7,510,177 B2
(45) Date of Patent: Mar. 31, 2009

(54) SHEET POST-PROCESSING APPARATUS AND IMAGE FORMATION APPARATUS

(75) Inventors: Jinichi Nagata, Osaka (JP); Hidetoshi Kaneko, Yamatokoriyama (JP); Hideo Yoshikawa, Yamatokoriyama (JP); Sei Takahashi, Minami Alps (JP); Mamoru Akiyama, Yamanashi (JP); Tomohisa Shimizu, Minami Alps (JP); Shin Tsugane, Hokuto (JP)

(73) Assignees: Sharp Kabushiki Kaisha, Osaka (JP); Nisca Corporation, Yamanashi-ken (JP)

( * ) Notice: Subject to any disclaimer, the term of this patent is extended or adjusted under 35 U.S.C. 154(b) by 252 days.

(21) Appl. No.: 11/366,931

(22) Filed: Mar. 1, 2006

(65) Prior Publication Data

US 2006/0202402 A1 Sep. 14, 2006

(30) Foreign Application Priority Data

Mar. 1, 2005 (JP) ..... 2005-056070
Mar. 10, 2005 (JP) ..... 2005-067277

(51) Int. Cl.
*B65H 37/04* (2006.01)

(52) U.S. Cl. ..... 270/58.08

(58) Field of Classification Search ..... 270/58.08; 399/407, 410

See application file for complete search history.

(56) References Cited

U.S. PATENT DOCUMENTS

| | | | | |
|---|---|---|---|---|
| 5,013,021 | A * | 5/1991 | Johdai et al. | 270/58.12 |
| 5,114,130 | A * | 5/1992 | Hamanaka et al. | 270/58.11 |
| 6,120,020 | A * | 9/2000 | Asao | 271/189 |
| 6,889,971 | B2 * | 5/2005 | Tamura et al. | 270/58.11 |
| 2004/0022563 | A1 * | 2/2004 | Maruchi et al. | 399/365 |

FOREIGN PATENT DOCUMENTS

| | | |
|---|---|---|
| JP | 64048775 | 2/1989 |
| JP | 11194701 | 7/1999 |
| JP | 2002287445 | 10/2002 |
| JP | 2003255809 | 9/2003 |
| JP | 2003-312920 | 11/2003 |
| JP | 2003/312920 | 11/2003 |
| JP | 2003-335449 | 11/2003 |

* cited by examiner

*Primary Examiner*—Gene Crawford
*Assistant Examiner*—Leslie A Nicholson, III
(74) *Attorney, Agent, or Firm*—Michaud-Duffy Group LLP

(57) ABSTRACT

In one embodiment of the present invention, a sheet post-processing apparatus includes an ejection path that successively feed sheets each with an image found thereon from an ejection outlet. A processing tray is disposed under the ejection outlet to temporarily store sheets fed from the ejection path. A port processing unit performs post processing such as binding and punching. The post processing unit is located under the ejection path and is provided with a cooling fan that sends air toward the post processing unit.

10 Claims, 28 Drawing Sheets

SHEET POST-PROCESSING APPARATUS AND IMAGE FORMATION APPARATUS

CROSS-REFERENCE TO RELATED APPLICATIONS

This application claims priority to Japanese Patent Application No. 2005-056070, filed Mar. 1, 2005, and Japanese Patent Application No. 2005-067277, filed Mar. 10, 2005, the subject matter of these patents is incorporated by reference herein in their entirety.

BACKGROUND OF THE INVENTION

1. Field of the Invention

The present invention relates to a sheet post-processing apparatus that performs post-processing such as stapling, punching, bookbinding and the like on sheets fed from an image formation apparatus such as a copy machine, printer and the like and the image formation apparatus installed with the sheet post-processing apparatus, and more particularly, to the sheet post-processing apparatus incorporated into an image formation apparatus and the image formation apparatus that effectively cools peripheral portions of the sheet post-processing apparatus.

2. Description of Related Art

With progress of multifunction of image formation apparatuses, such image formation apparatuses have been used that have sheet post-processing functions for performing post-processing on printed sheets. Examples of such a sheet post-processing functions are stapling, punching, bookbinding and the like. In many conventional image formation apparatuses, a sheet post-processing apparatus to perform such sheet post-processing is disposed outside the image formation apparatus.

Meanwhile, to reduce the size of the image formation apparatus with the sheet post-processing functions, apparatuses have been known which have the sheet post-processing functions and are disposed inside the image formation apparatus, instead of placing the sheet post-processing apparatus outside the image formation apparatus.

For example, JP 2003-335449 (Document 1) discloses an image formation apparatus where a sheet post-processing section is provided in U-shaped space formed by an original reading section, printing section and paper feed section.

Further, JP 2003-312920 (Document 2) also discloses an image formation apparatus that stores a sheet post-processing apparatus inside thereof, as in Document 1.

However, in a configuration where a sheet post-processing apparatus is disposed in the U-shaped space formed inside an image formation apparatus as in the image formation apparatus as described in Document 1, the sheet post-processing apparatus and image formation apparatus are disposed adjacent to each other, and heat tends to remain inside the apparatus in such a configuration. Particularly, when the sheet post-processing apparatus is disposed adjacent to the image formation apparatus, there is a possibility that heat generated on the image formation apparatus side, particularly, heat emitted from a fusing roller or the like, is conveyed to the sheet post-processing apparatus side, and therefore, some type of cooling structure is required also on the sheet post-processing apparatus side. Then, to obtain sufficient cooling effect by forming a cooling structure on the sheet post-processing apparatus side, it is necessary to guarantee sufficient air passages inside the apparatus, but it has been difficult to reserve sufficient air passages inside the conventional image formation apparatus.

Further, in the image formation apparatus as described in Document 2, sheets placed on a mount tray are cooled by sending cold air to the sheets on the tray from a fan apparatus provided above the tray.

However, in image formation apparatuses such as laser printers, temperatures ranging from about 150° C. to about 200° C. are applied to a sheet to fuse toner ink, and the ambient temperature of the sheet post-processing section thereby increases significantly. Therefore, even when cold air is sent to sheets placed on the mount tray, the sheets themselves become high temperatures inside a feeding path in the image formation apparatus, and thereby, are sometimes adhered to each other due to the viscosity of the toner ink, and the so-called blocking phenomenon (adhesion of ejected sheets) may occur. Further, when the temperature increases in an ejection path for a sheet to travel from the fusing section to an ejection outlet in the image formation apparatus, the sheet curls and becomes a cause of trouble such as a jam and the like.

The present invention is carried out in view of the above-mentioned problems in the conventional image formation apparatus, and it is an object of the invention to effectively cool with a simplified structure a sheet itself and/or a mechanical part of a post-processing apparatus and the like in the process of feeding the sheet from an image formation section to a mount tray.

SUMMARY OF THE INVENTION

To achieve the above-mentioned object, as a first aspect of the invention, the invention provides a sheet post-processing apparatus having an ejection path that successively feeds sheets each with an image formed thereon from an ejection outlet, a processing tray that is disposed under the ejection outlet to temporarily store the sheets fed from the ejection path, and a post-processing unit that performs post-processing such as binding processing, punching processing and the like on the sheets on the processing tray, where the post-processing unit is located under the ejection path, disposed to move in the direction perpendicular to the sheet feeding direction, and is provided with a cooling fan that sends air toward the post-processing unit from the direction in which the unit moves.

By this means, the cold air from the cooling fan hits the post-processing unit to cool the unit, while being changed in direction toward the ejection path, and is capable of effectively cooling guide members forming the path and sheets passed through the path.

Herein, the post-processing unit is provided with a stapler that performs binding processing on sheets on the processing tray, a guide member that supports the stapler to be movable along a rear end edge of the sheets on the processing tray, and driving means for controlling travel of the stapler along the guide member. The ejection path is comprised of a plate-shaped guide member that guides a sheet, and the plate-shaped guide member is provided with a plurality of air vents in a region where the post-processing unit is disposed.

Then, the driving means controls travel of the stapler to move along the guide member to a position such that the air from the cooling fan is guided to the ejection path, and to a position such that post-processing is performed on sheets on the processing tray, and further move along the guide member to the position such that the air from the cooling fan is guided to the ejection path, and to the position such that post-processing is performed on sheets on the processing tray.

As a second aspect of the invention, the invention further provides a sheet post-processing apparatus which is used in an image formation apparatus and has a cooling fan located on the front side, and a stapling mechanism section located on an air path of the cooling fan, where the stapling mechanism section waits in the vicinity of the cooling fan at the standby time, the cooling fan operates while the stapling mechanism section is moved to the back of the sheet post-processing apparatus to and stopped at the time of operation of the image formation apparatus, and the stapling mechanism section is moved to a predetermined stapling position to execute stapling processing at the time of the stapling processing.

By this means, in the sheet post-processing apparatus, the stapling mechanism section waits on the front side of the sheet post-processing apparatus in the vicinity of the cooling fan at the operation-standby time, and it is thereby made possible to perform exchange and/or refill of staples with ease.

The sheet post-processing apparatus is provided to be movable relative to the image formation apparatus, and is provided with an operation member that fixes and releases travel of the sheet post-processing apparatus, and the cooling fan is provided in the vicinity of the operation member. Then, the cooling fan starts rotating at the time of starting image formation, and the stapling mechanism section starts travel backward from the standby position at the time of starting image formation.

At the time the cooling fan is operating, the stapling mechanism section moves toward the back of the sheet post-processing apparatus and stops at a beforehand set given position, and sufficient space, i.e. air passage is thereby reserved between the cooling fan and the stapling mechanism section. It is thus possible to adequately flow the air to the circuit board and the like disposed at the back of the sheet post-processing apparatus.

DETAILED DESCRIPTION OF THE PREFERRED EMBODIMENTS

Two embodiments of a sheet post-processing apparatus and an image formation apparatus with the sheet post-processing apparatus incorporated therein according to the present invention will specifically be described below with reference to accompanying drawings.

FIGS. 1 to 12 illustrate an embodiment based on the first aspect of the invention specifically, and FIGS. 13 to 27 illustrate an embodiment based on the second aspect of the invention specifically. The two aspects of the invention have a common technical idea of the invention that fan means sends air to the sheet post-processing apparatus incorporated into the image formation apparatus and to sheets in their lateral direction with excellent air passages reserved, and thereby implements effective cooling.

Descriptions of the First Embodiment of the Invention

Figure 1:
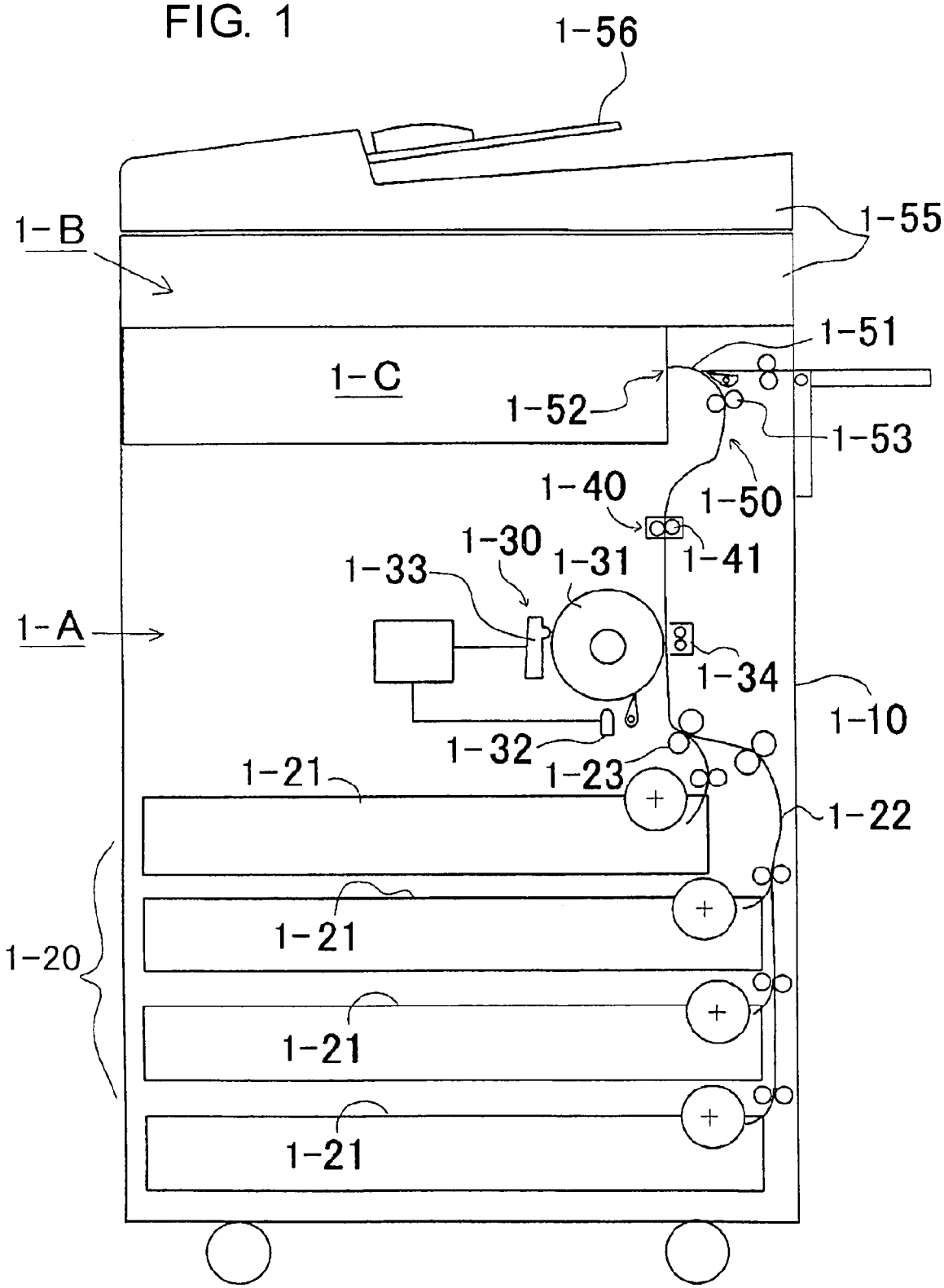
FIG. 1 is an entire view of an image formation apparatus according to the present invention.
Figure 2:
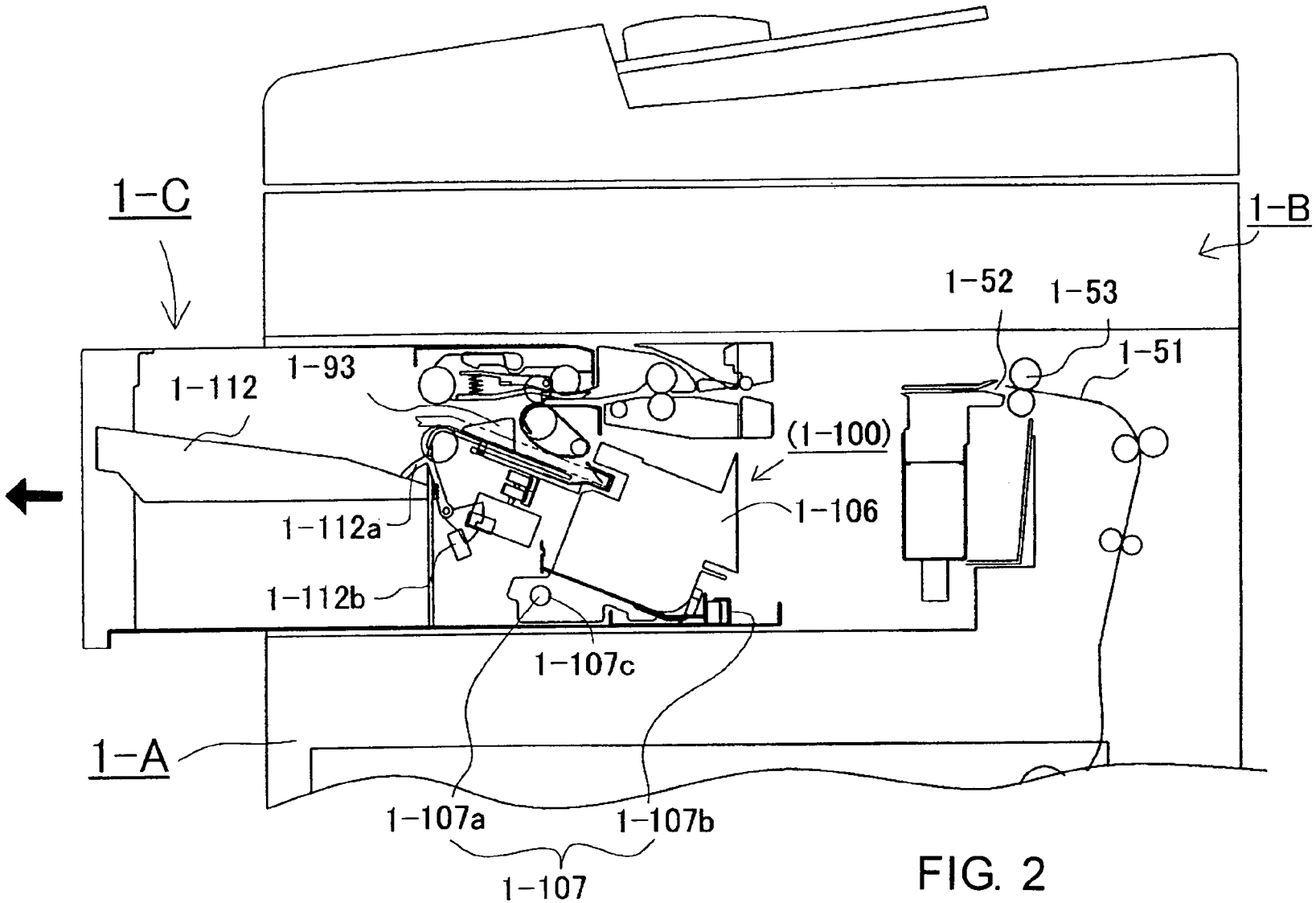
FIG. 2 is a principal-part enlarged explanatory view of a finisher unit section.
Figure 3:
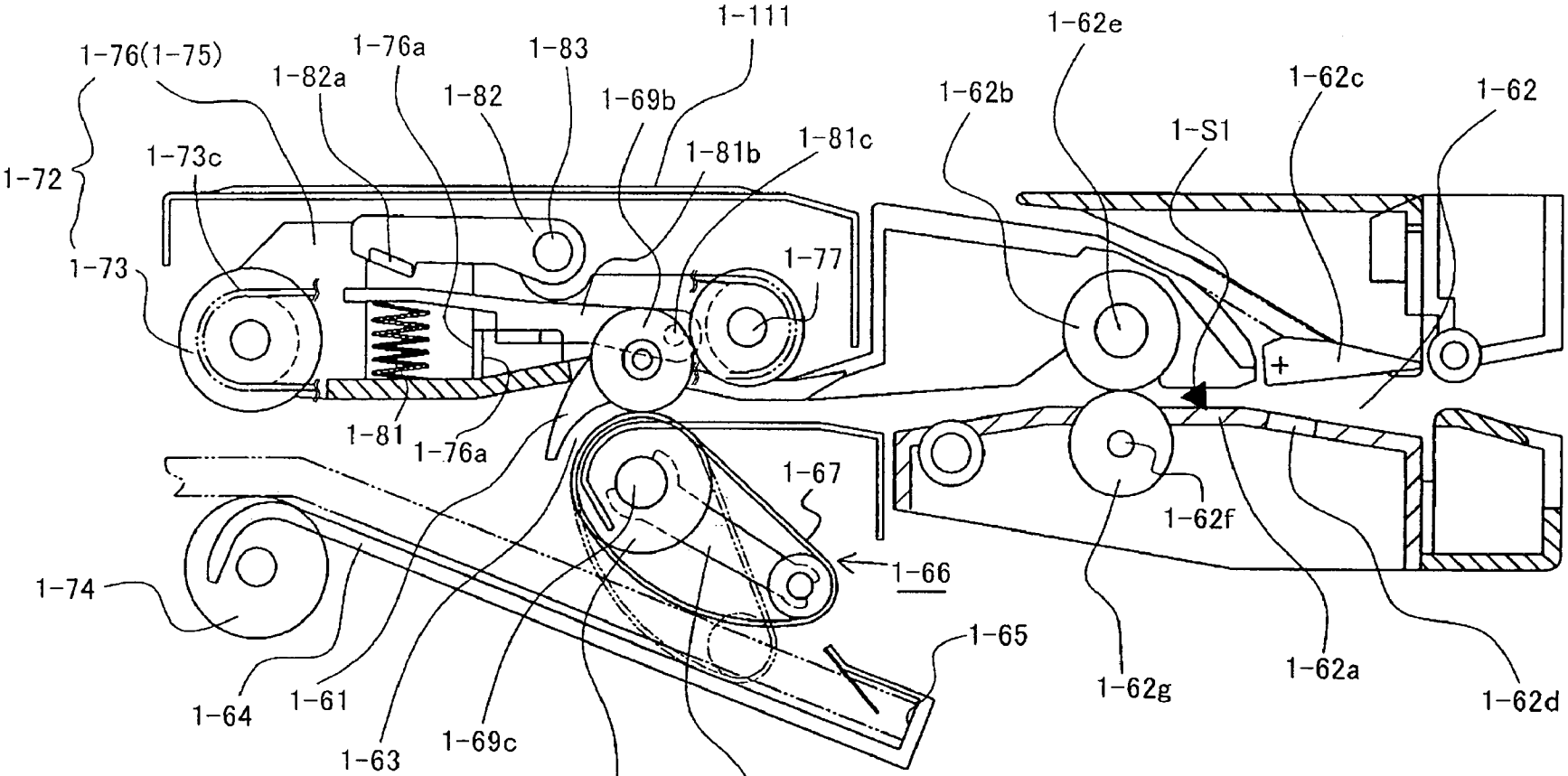
FIG. 3 is an explanatory view of the finisher unit section.
Figure 4:
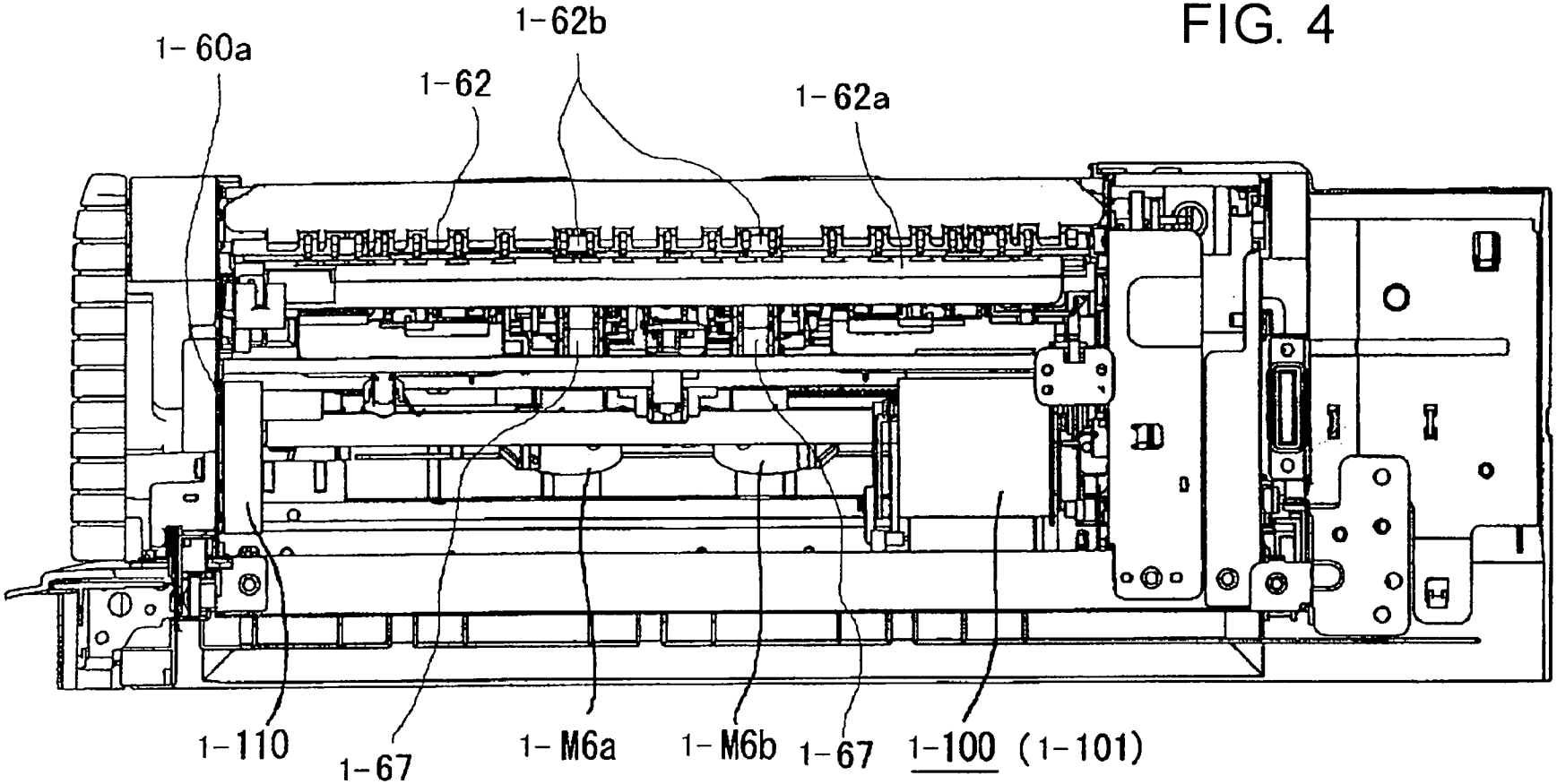
FIG. 4 is an upper view of the finisher unit section.
Figure 5:
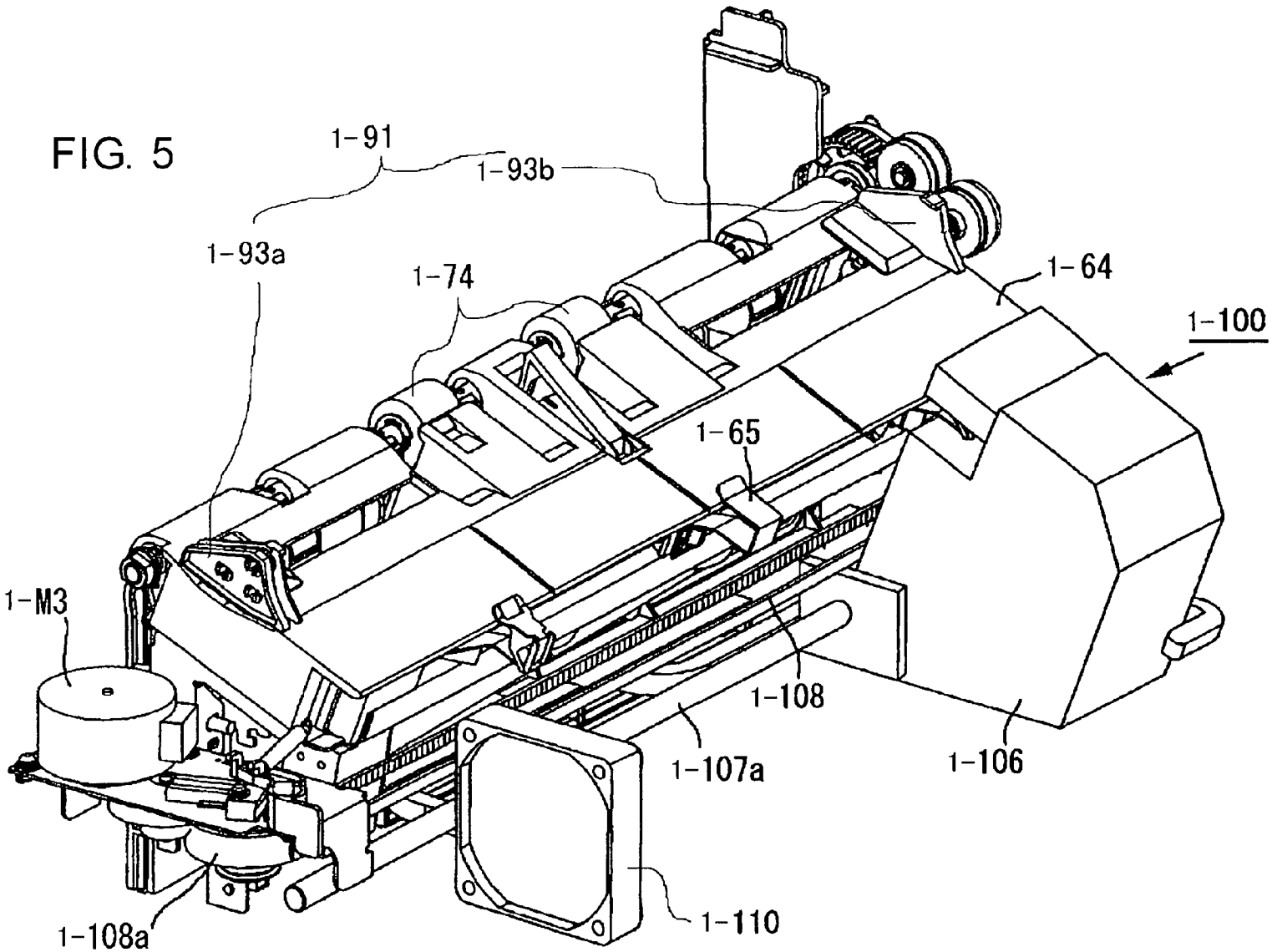
FIG. 5 is a perspective view showing a structure of the finisher unit section.

FIG. 1 is an entire view of an image formation apparatus according to the first embodiment of invention, FIG. 2 is a principal-part enlarged explanatory view of a finisher unit section, and FIG. 3 is an explanatory view of the finisher unit section.

The image formation apparatus as shown in FIG. 1 is comprised of an image formation unit 1-A, image scanning unit 1-B and finisher unit 1-C. The image formation unit 1-A is comprised of an exterior casing 1-10 incorporating a paper feeding section 1-20, printing section 1-30, fusing section 1-40, and paper ejecting section 1-50, and as its structure, various structures are known such as a copy machine, printer and the like. The paper feeding section 1-20 shown in the figure is comprised of a plurality of paper feed cassettes 1-21, and feeding rollers (not shown) that sequentially separate sheets in the paper feed cassettes 1-21 for each sheet to feed, accommodates different-size sheets in the paper feed cassettes 1-21, and selectively feeds a sheet in response to a printing size.

The paper feed cassettes 1-21 are provided with a feeding path 1-22 at respective sheet dispensing ends to feed a sheet to a register roller 1-23. The register roller 1-23 corrects skew of a front end of the sheet and causes the sheet to wait at this position. The printing section 1-30 is provided downstream of the register roller 1-23. Various mechanisms of printing are known for the printing section 1-30 such as electrostatic printing, inkjet printing, silk screen printing and the like, and the printing section 1-30 in the figure adopts the electrostatic printing mechanism. Around an electrostatic drum 1-31 are provided a printing head 1-32, developer 1-33, transfer charger 1-34, and cleaning header (not shown). The printing head 1-32 forms a latent image on the electrostatic drum 1-31, the developer 1-33 applies toner ink to the drum 1-31, and the transfer charger 1-34 transfers the ink onto the sheet to form an image. The printing section 1-30 in the figure performs monochrome printing. In the case of color printing, for example, first and second, two electrostatic drums (or belts), are provided, toner ink formed on the first electrostatic drum is transferred to the second electrostatic drum, such transfer is repeated a plurality of times corresponding to color components of Y (Yellow), M (Magenta) and C (Cyan), and a color image is thereby formed on the second electrostatic drum. Then, the color image on the second electrostatic drum is transferred to a sheet.

The sheet with the toner ink thus transferred thereto is fed to the fusing section 1-40. The fusing section 1-40 is provided with a pair of rollers (fusing rollers) 1-41 that fuse the toner ink to fix. The fusing rollers 1-41 apply heat ranging from 150° C. to 200° C. to an image on the sheet corresponding to components of the toner ink, and cause the ink to be fused into the sheet. The sheet with the image formed thereon in the fusing section 1-40 is fed to a paper ejecting section 1-50. The paper ejecting section 1-50 is comprised of an ejecting path 1-51 that guides a sheet to an ejection outlet 1-52, and ejecting rollers 1-53 provided in the path.

Accordingly, an original image which is formed in an external apparatus such as a computer and the like or transferred from the image scanning unit 1-B described later is output to the printing head 1-32 sequentially via a data storage device such as a hard disk and the like. In the printing head 1-32, a light beam such as a laser beam and the like is applied to the electrostatic drum 1-31 corresponding to the image data, the developer 1-33 adheres the toner ink onto the drum, and the transfer charger 1-34 forms an image on the sheet. The sheet with the image thus formed thereon is fed to the ejection outlet 1-52 from the ejecting path 1-51 sequentially.

Described next is the image scanning unit 1-B. The image scanning unit 1-B is disposed above the image formation unit 1-A, and is well known as the so-called scanner that reads an original image on an original sheet. A structure of the unit 1-B is not shown, but briefly described below.

In FIG. 1, "1-55" denotes a unit casing, and "1-56" denotes an original mount. A platen formed of glass or the like is provided in the casing 1-55, and under the platen are provided an optical mechanism including a source lamp and image-forming lenses, and a photoelectric conversion element. Light of the source lamp is applied to an original on the platen, and the reflected light is sent to the photoelectric conversion element such as a line sensor or the like by the image-forming mechanism including mirrors and lenses to form an image. Above the platen is provided a feeder that feeds the original on the original mount to the platen successively at predetermined speed. An image on the original fed by the feeder is read electrically by the photoelectric conversion element.

The finisher unit 1-C will be described below. As shown in FIGS. 2 and 3, the finisher unit 1-C is disposed between the image formation unit 1-A and image scanning unit 1-B as described above. The finisher unit 1-C is comprised of an ejecting path 1-62 (hereinafter referred to as a unit ejecting path) connected to the ejection outlet 1-52 (hereinafter, referred to as a main-body ejection outlet) of the image formation unit 1-A, a processing tray 1-64 that temporarily stores sheets from the unit ejecting path 1-62, a post-processing apparatus 1-100 that performs post-processing on the sheets on the processing tray 1-64, and a collection tray 1-112 that stores the processed sheets sent from the processing tray 1-64. The unit ejecting path 1-62 is provided with a guide sheet 1-62*a* that guides a sheet, a feeding roller 1-62*b* (driving-side roller) and a feeding roller 1-62*g* (following-side roller) that feed the sheet, and a path switching piece 1-62*c* described later that guides the sheet to an overflow tray 1-111. In addition, "1-62*f*" denotes an axis that supports the feeding roller 1-62*g* (following-side roller) onto the guide plate 1-62*a*.

The ejection outlet 1-63 of the unit ejecting path 1-62 is provided with ejection rollers 1-69 comprised of a driving-side roller 1-69*a* and following-side roller 1-69*b* which feed the sheet from the ejection outlet 1-63 sequentially. Downstream of the ejection outlet 1-63 is provided the processing tray 1-64 with different heights under the outlet 1-63. The driving-side roller 1-69*a* of the ejection outlet 1-63 is provided with transport means 1-66 that feeds the sheet to positioning means 1-65 described later. Known as the transport means 1-66 thus provided at the ejection outlet 1-63 are a caterpillar belt, paddle feeding mechanism and the like. The means 1-66 in the figure is comprised of a caterpillar belt 1-67 such that a plurality of protrusions is formed on a surface of an endless belt to push out a rear end of the sheet.

The caterpillar belt 1-67 is fitted at one end in a pulley provided in the driving axis 1-69*c* of the driving-side roller 1-69*a*, while being fitted at the other end in a pulley attached to a support arm 1-68 coupled to the driving axis 1-69*c* to enable swings about the axis. Accordingly, the caterpillar belt 1-67 is supported to enable swings with respect to the driving axis 1-69*c* of the ejecting rollers 1-69, and comes into contact at its front end with a surface of the sheet mounted on the processing tray 1-64, while being revolved at rear end by the driving axis 1-69*c*.

The sheet from the unit ejecting path 1-62 is ejected from the ejection outlet 1-63 by the ejecting rollers 1-69 successively, sent to the processing tray 1-64 by the upper face side of the caterpillar belt 1-67, and fed inversely along the highest sheet on the processing tray 1-64 by the lower face side of the belt. In addition, "1-61" denotes a guide piece provided at the ejection outlet 1-63, and withdraws upward when the front end of the sheet enters, while guiding the rear end of the sheet in the direction of the processing tray along the caterpillar belt 1-67. The processing tray 1-64 is provided with the positioning means 1-65 to strike the sheet to regulate, and the sheet is aligned along the positioning means 1-65. The positioning means in the figure is comprised of a protrusion member protruding from the processing tray 1-64 at a position such that the rear end of the sheet in the feeding direction is struck to be regulated.

In a configuration of the protrusion member, the processing tray 1-64 is disposed with different heights forming under the unit ejecting path 1-62, the processing tray 1-64 is provided with the positioning means 1-65 at the rear end side in the feeding direction, and the sheet is switched back in the feeding direction from the ejection outlet 1-63, and struck and regulated at the rear end by the positioning means 1-65. The post-processing apparatus 1-100 described below is disposed such that post-processing is performed on rear ends of sheets regulated by the positioning means 1-65. Adopted as the post-processing apparatus 1-100 are a punching mechanism that performs punching processing on sheets stacked in the shape of a bundle at the regulation position on the processing tray 1-64, a stapler mechanism that performs stapling processing on such sheets, and the like. A stapler mechanism 1-101 will be described below.

The post-processing apparatus 1-100 comprised of the stapler mechanism 1-101 is configured such that a stapler head and anvil block not shown are incorporated into the housing 1-106, a needle-shaped staple is bent in U-shape and pushed into a bundle of sheets, and front ends of the staple are bent by the anvil block to bind the sheets. The housing 1-106 is comprised of a channel cross-section frame member, and a head block and the anvil block are disposed respectively in a pair of right and left side frames 1-60*a* to enable pressurizing-contact and separation therebetween. Generally, the head block is attached to one of upper/lower lever members sharing rear ends as an axis, while the anvil block is attached to the other member. The upper/lower lever members reciprocate between a separation position and pressurizing-contact position by a cam member attached to the side frames 1-60*a* and a cam driving motor 1-M5 (not shown) that drives the cam member.

During of this operation, the head block bends a linear staple in U-shape by a former member, and press-inserts the U-shaped staple into a bundle of sheets by a driver member. Meanwhile, the anvil block is provided with an anvil (pedestal) to bend front ends of press-inserted staple inward. Accordingly, the post-processing apparatus 1-100 is comprised as a unit of the stapler head, anvil block, cam member that causes the head and block to move from the separation position to pressurizing-contact position to perform binding operation, and cam driving motor 1-M5 (not shown). In addition, the post-processing apparatus 1-100 is provided detachably with a cartridge that accommodates staples.

The post-processing apparatus 1-100 configured as described above is attached movably along a guide rail 1-107 provided in an apparatus frame of the finisher unit 1-C described later. In other words, the processing tray 1-64 and positioning means 1-65 are disposed under the unit ejecting path 1-62 in the direction perpendicular to the sheet feeding direction, and the stapler mechanism 1-101 is disposed movably along the positioning means 1-65, and performs the post-processing at a predetermined position of the rear ends of sheets.

The processing tray 1-64 is equipped with aligning means 1-91 as described below. The aligning means 1-91 regulates a side edge of the sheet perpendicular to the feeding direction and stores the sheet in a predetermined posture on the processing tray. In the apparatus as shown in the figure, the sheet is fed to the unit ejecting path 1-62 from the image formation unit 1-A with respect to the center. Therefore, sheets with a different width size from the ejection outlet 1-63 are stacked on the processing tray 1-64 with respect to the center in the feeding direction, and rear end edges of the sheets are struck by the positioning means 1-65.

Figure 8:
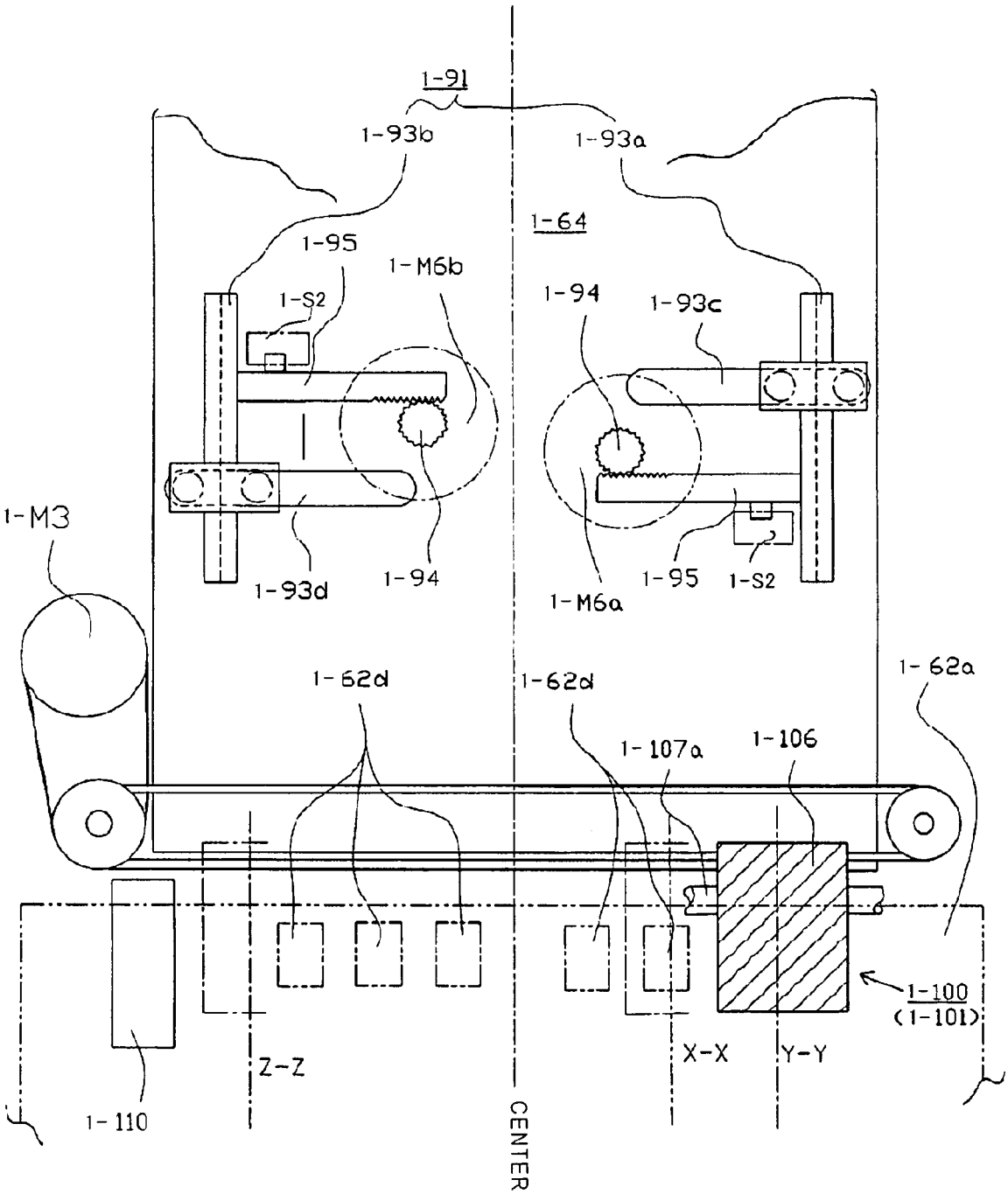
FIG. 8 is an explanatory view of a structure of a registering plate and operation of the post-processing apparatus.

Therefore, as shown in FIG. 8, the aligning means 1-91 is comprised of a pair of aligning plates 1-93, right aligning plate 1-93*a* and left aligning plate 1-93*b*. The tray-shaped processing tray 1-64 is provided with slit grooves 1-93*c* and 1-93*d* in the lateral direction, the L-shaped cross-section aligning plates 1-93 are fitted in the slit grooves 1-93*c* and 1-93*d* movably, and on the rear side of the processing tray 1-64 are provided racks 1-95, having tooth flanks in the direction of the slit grooves 1-93*c* and 1-93*d*, integrally provided with the aligning plates 1-93, respectively. The right/left aligning plates 1-93*a* and 1-93*b* are held slidably respectively by the slit grooves 1-93*c* and 1-93*d* in the same structure, and pinions 1-94 engage in the integrally formed racks 1-95. The right and left pinions 1-94 are respectively coupled to aligning motors 1-M6*a* and 1-M6*b* via reduction gears.

The aligning motors 1-M6*a* and 1-M6*b* as shown in the figure are stepping motors, and when supplied with predetermined power supply pulses, cause the right and left aligning plates 1-93*a* and 1-93*b* to come close or away to/from each other by the same distance. The aligning plates 1-93*a* and 1-93*b* are each provided with positioning sensors 1-S2, and home positions are set at position such that the aligning plates 1-93*a* and 1-93*b* are symmetric with respect to the center of the sheet. From this position, when the aligning motors 1-M6*a* and 1-M6*b* rotate by the same amount, the right and left aligning plates 1-93*a* and 1-93*b* move toward the center side and push side edges of sheets. When a control section (control CPU 1-90) of the finisher unit 1-C receives a width size signal of the sheet fed out of the image formation unit 1-A and supplies power supply pulses corresponding to the sheet width to the aligning motors 1-M6*a* and 1-M6*b*, the right and left aligning plates 1-93*a* and 1-93*b* move to standby positions corresponding to the sheet size, align the width of the sheets when the sheets are delivered on the processing tray 1-64, and thus are capable of positioning the sheets with reference to the center neatly.

The sheets thus aligned on the processing tray 1-64 undergo the post-processing by the post-processing apparatus 1-100 as described previously. The post-processing apparatus 1-100 is supported slidable on the guide rail 1-107 provided in the finisher unit 1-C. As shown in FIG. 2, the guide rail 1-107 is comprised of a guide axis 1-107*a* and slider 1-107*b* attached to the side frame 1-60*a* of the finisher unit 1-*c*, and the guide axis 1-107 is fitted with a fitting hole 1-107*c* provided in the housing 1-106 of the post-processing apparatus 1-100 to be supported, while the slider 1-107*b* engages in a roller provided in the housing 1-106 to be supported. A driving belt 1-108 is laid between a pair of pulleys along the guide axis 1-107*a*, the housing 1-106 is fixed to part of the driving belt 1-108, and a unit moving motor 1-M3 is coupled to one of the pulleys, 1-108*a* (see FIG. 5).

The unit moving motor 1-M3 is comprised of a stepping motor, and moves the post-processing apparatus 1-100 by a predetermined amount corresponding to the supplied pulse current. A position sensor not shown is provided in the housing 1-106, and the apparatus 1-100 is moved from a home position to a predetermined position in the sheet lateral direction corresponding to the number of power supply pulses supplied to the unit moving motor 1-M3. The position sensor is configured, for example, such that an actuator is provided in the housing 1-106 while a photo sensor is provided in the unit frame.

A feeding mechanism will be described below to feed processed sheets from the processing tray 1-64. The collection tray 1-112 described later adjacent to the processing tray 1-64 is provided with feeding means 1-72 for feeding sheets. The feeding means 1-72 is comprised of driving rollers 1-73 that feed sheets, and roller supporting means 1-75 for supporting the driving rollers 1-73 movable between an operation position to come into contact with the sheets and a withdrawal position spaced away from the sheets.

The feeding means 1-72 as shown in the figure is configured such that an arm member 1-76 is provided having the rear end portion coupled to a revolving axis 1-77 fixed to a unit frame (not shown), and is provided at front end as a bearing with two driving rollers 1-73*a* and 1-73*b* in the sheet width direction, and that driving of the revolving axis 1-77 is conveyed to the driving rollers 1-73 by a convey belt 1-73*c*. Accordingly, the driving rollers 1-73 rotate in the sheet feeding direction by driving of the revolving axis 1-77, while swinging about the revolving axis 1-77 as a center and being supported between the operation position to come into contact with the sheet and the withdrawal position to be movable upward and downward.

Figure 9:
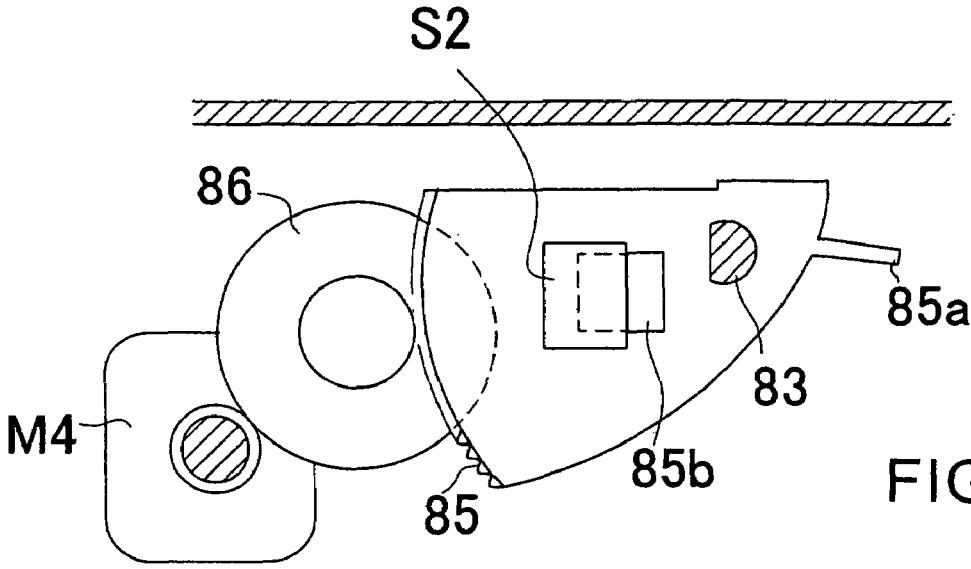
FIG. 9 is an explanatory view showing a driving structure of a pressurizing lever.
Figure 10:
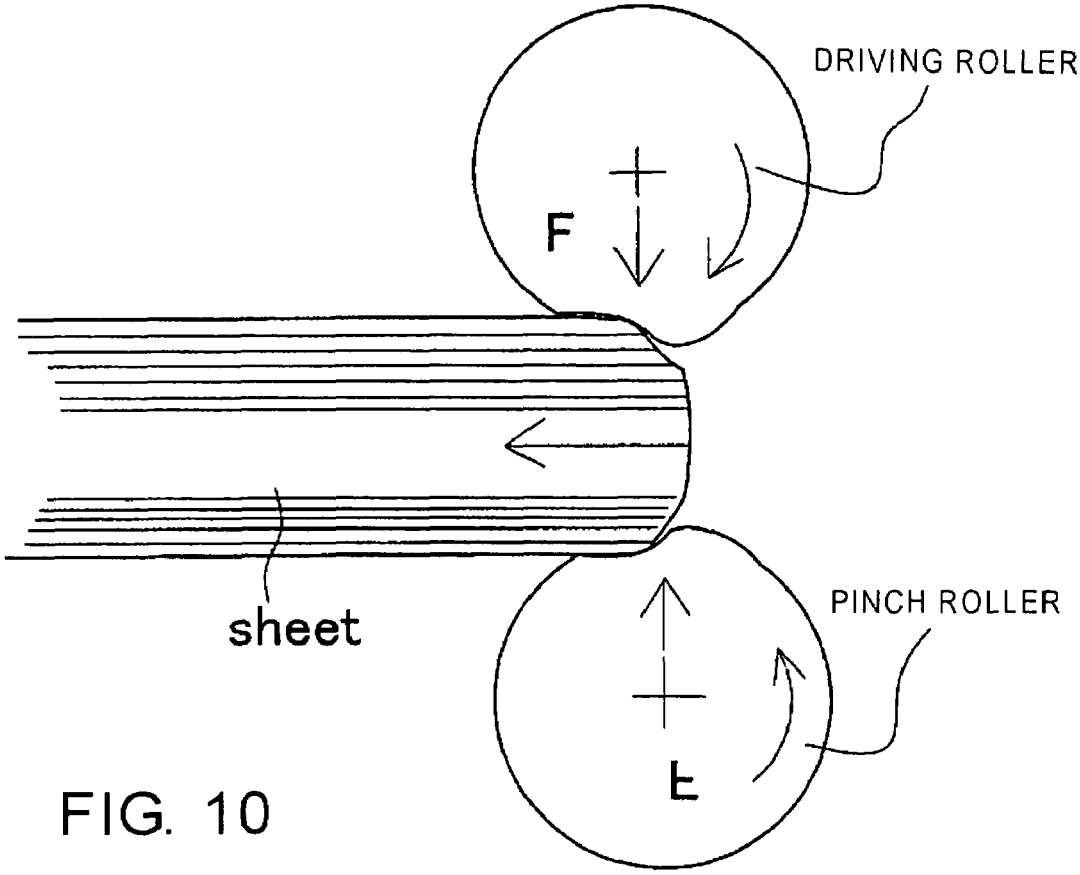
FIG. 10 is a conceptual view of a conventional apparatus.

The arm member 1-76 is provided with pressing-force applying means 1-80 as described below. A pressurizing lever 1-82 is provided having a rear end portion coupled to the rotation supporting axis 1-83 fixed to the unit frame (not shown) as in the arm member 1-76, and a front end portion of the lever 1-82 is engaged in the arm member 1-76. As shown in FIG. 9, a pressurizing motor 1-M4 comprised of a stepping motor is coupled via a driving gear 1-86 to a sector-shaped gear 1-85 integrally provided with the rotation supporting axis 1-83 and thus to the rotation supporting axis 1-83. By forward and reverse rotations of the pressurizing motor 1-M4, counterclockwise rotation of the rotation supporting axis 1-83 raises the pressurizing lever 1-82, while the clockwise rotation of the axis 1-83 lowers the lever 1-82, as viewed in FIG. 9.

The section-shaped gear 1-85 is provided with an upper limit stopper 1-85*a* that prevents a rise more than a predetermined level, and the stopper comes into contact with the unit frame not shown to prohibit a further rise. The section-shaped gear 1-85 is integrally provided with an actuator 1-85*b*, and a position sensor 1-S2 attached to the unit frame detects the actuator. Accordingly, the position sensor 1-S2 detects an original position of the section-shaped gear 1-85, and using such a position as a starting point, rotating the pressuring motor 1-M4 in a predetermined direction by a predetermined amount permits control of upward and downward operation of the pressurizing lever 1-82.

The pressurizing lever 1-82 is provided at front end with a wing-shaped engaging piece 1-82*a*, and the engaging piece 1-82*a* is fitted with an engaging groove 1-76*a* formed in the arm member 1-76. A force-storing spring 1-81 is provided between the arm member 1-86 and pressurizing lever 1-82, the downward movement of the pressurizing lever 1-82 is conveyed to the arm member 1-76 via the force-storing spring 1-81, and the driving rollers 1-73 are supported by the arm member 1-76 as a bearing. Meanwhile, with respect to the upward movement of the pressurizing lever 1-82, the engaging piece 1-82*a* comes into contact with an upper wall of the engaging groove 1-76*a*, thereby raising the arm member 1-76.

Accordingly, by forward and reverse rotations of the pressurizing motor 1-M4, the pressurizing lever 1-82 moves the arm member 1-76 upward and downward, respectively, and the arm member presses the driving rollers 1-73 against sheets on the processing tray 1-64 via the force-storing spring 1-81 when moved downward. The pressing force can be controlled in level by control of the pulse current supplied to the pressurizing motor 1-M4. In addition, "1-81*b*" in the figure denotes a buffer lever coupled to the unit frame with an axis 1-81*c*, and a front end portion of the buffer lever is disposed between the force-storing spring 1-81 and pressurizing lever 1-82, while being fitted with an engaging hole 1-76*b* of the arm member 1-76 to hold the spring.

Meanwhile, in the processing tray 64, a pinch roller 1-74 is disposed at a position opposite to the driving rollers 1-73, and sheets on the processing tray 1-65 are nipped by the driving rollers 1-73 and pinch roller 1-74. The collection tray 1-112 is provided downstream of the processing tray 1-64 with the aforementioned structure, and stores processed sheet fed by the feeding means 1-72. The collection tray 1-112 in the figure is supported by the unit frame (not shown) on one side to be movable upward and downward along the guide rail on the frame side. The collection tray 1-112 moves downward corresponding to an amount of mounted sheets by a tray elevating motor M-7 (not shown), and always maintains a position of the highest sheet at a predetermined position. "1-112*a*" in the figure denotes a sensor that detects a height of the sheets, and "1-112*b*" is an actuator of the sensor. The sensor 1-112*a* detects a height position of the sheets on the tray, while detecting full sheets.

As described above, the finisher unit C is comprised of units separated from the image formation unit A, and installed as a unit into the ejection outlet 1-52 of the image formation unit 1-A, with the right and left side frames 1-60*a* fixed to the processing tray 1-64, the guide axis 1-107*a* and slider 1-107*b* that support (bear) the post-processing apparatus 1-100, and further, the guide rail 1-107 that supports the collection tray 1-112 to be movable upward and downward.

As shown in FIG. 2, the finisher unit 1-C is installed into the image formation unit 1-A in drawer-shape to be attachable and detachable. Therefore, guide rollers and guide rails not shown are provided in the side frames 1-60*a* and frames of the image formation apparatus to be fit with each other slidably, and in an inserted state as shown in FIG. 1, connectors for power supply and conveyance of various signals are coupled between the unit 1-C and the image formation unit 1-A. A cooling fan 1-110 is provided in the side frame 1-60*a* on the finisher unit 1-C side to send cold air toward the post-processing apparatus 1-100.

The cooling fan 1-110 is attached to the side frame 1-60*a* in the travel direction of the post-processing apparatus 1-100, i.e. in the direction perpendicular to the feeding direction of a sheet fed through the unit ejecting path 1-62. The guide plate 1-62*a* constituting the unit ejecting path 1-62 is provided with a plurality of air vents 1-62*d*. A sheet passed through the unit ejecting path 1-62 is fused at high temperature inside the image formation unit 1-A, the sheet and guide plate 1-62*a* both thereby become high temperatures, and such a heated sheet causes a curl, while the heated guide plate 1-62*a* increases the ambient temperature of the apparatus. At the same time, the post-processing apparatus 1-100 located under the guide plate 1-62*a* undergoes the temperature of the fuser 1-41 of the image formation unit 1-A, and becomes substantially the same temperature as the fusing temperature. In this state, for example, when a user touches the post-processing apparatus 1-100 for maintenance such as exchange of staples or the like, the user may feel the heat. The cooling fan 1-110 decreases the temperature of the surface, and it is possible to prevent such an event.

Figure 6A:
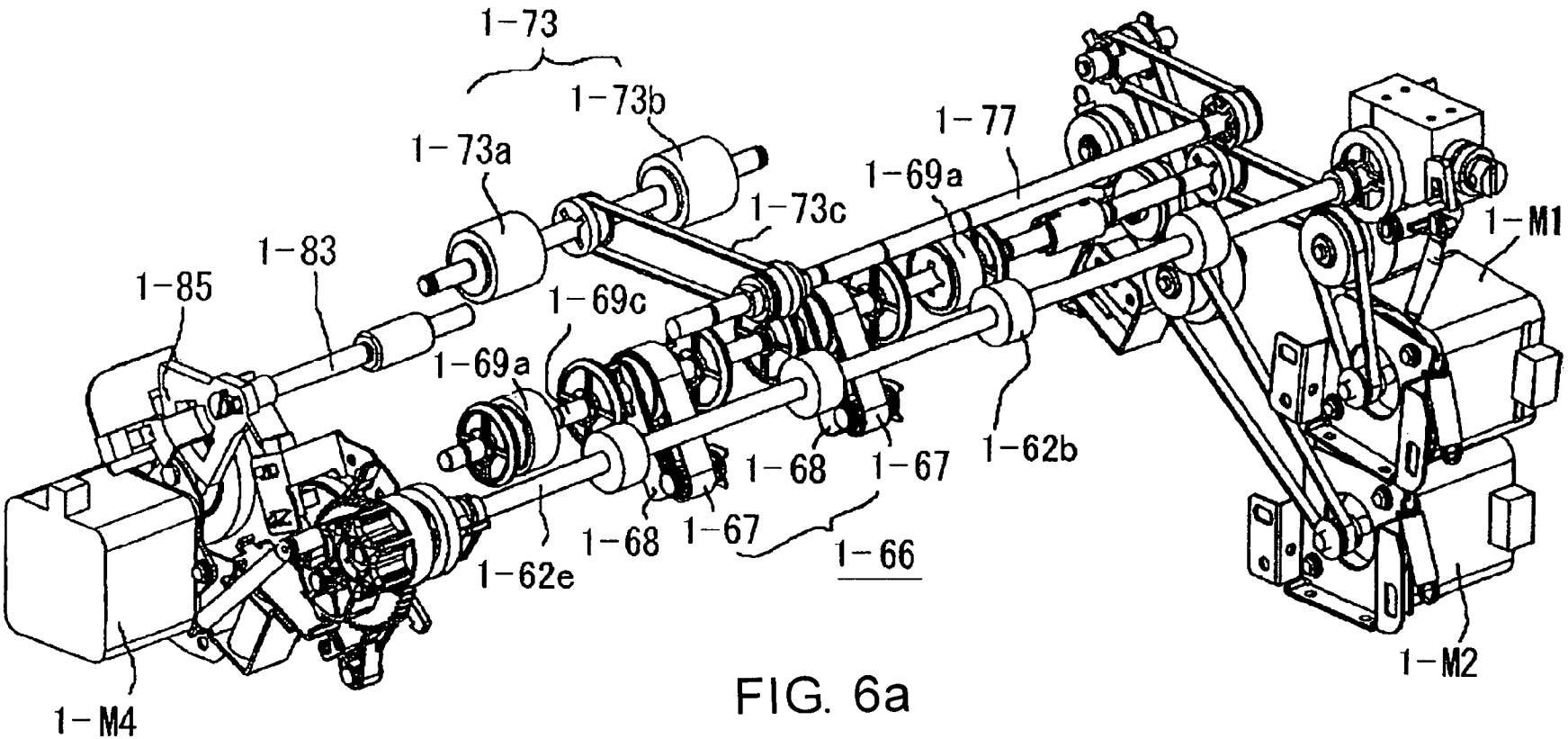
FIG. 6*a* is an explanatory view showing a structure of a driving mechanism according to the invention.
Figure 6B:
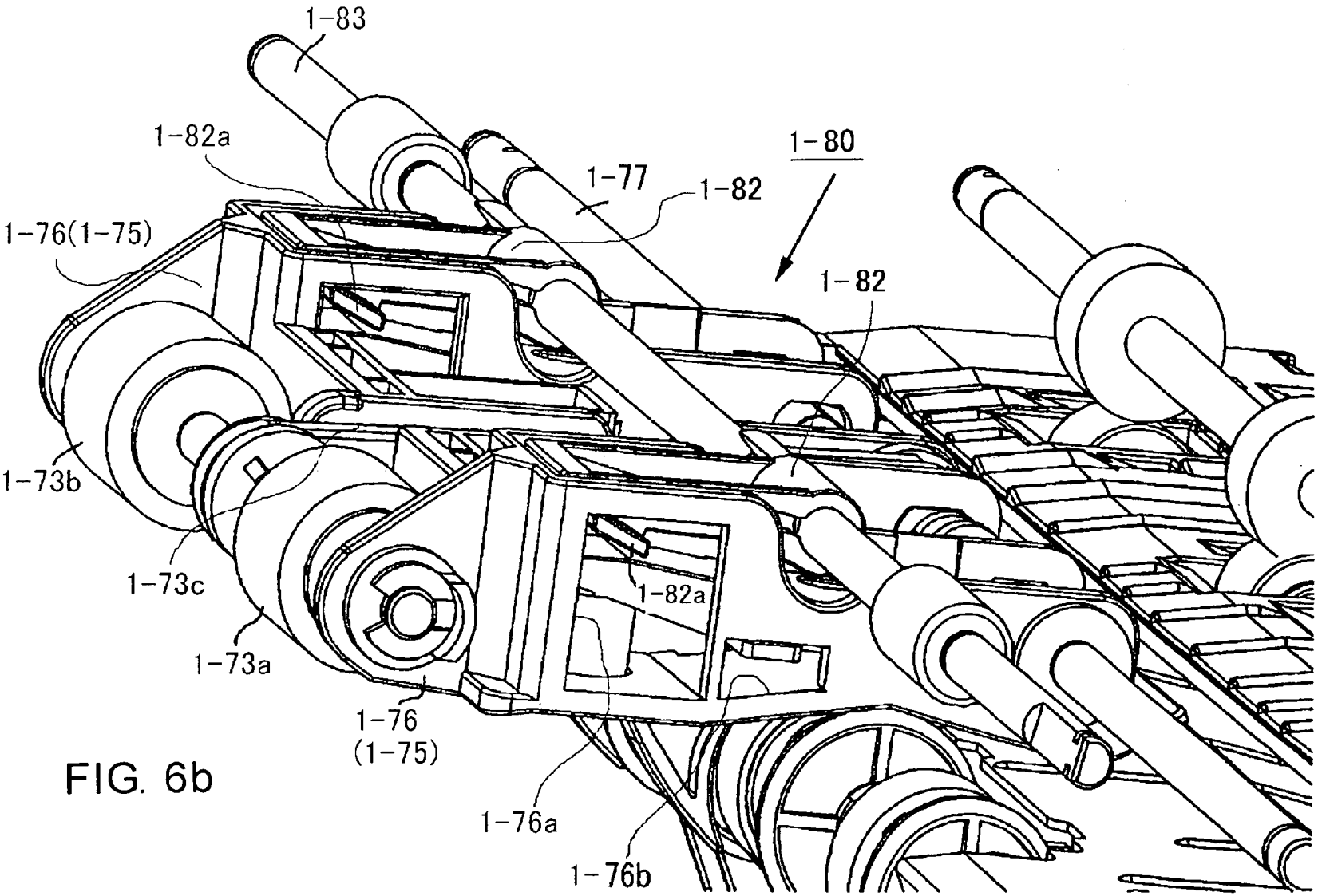
FIG. 6*b* is an enlarged perspective view showing a structure of roller supporting means.
Figure 6C:
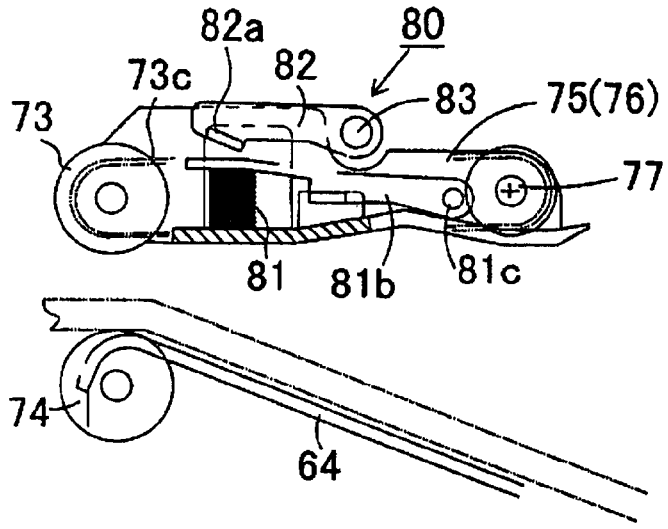
FIG. 6*c* is an explanatory view of a feeding mechanism (when the feeding mechanism is in a withdrawal position) according to the invention.
Figure 6D:
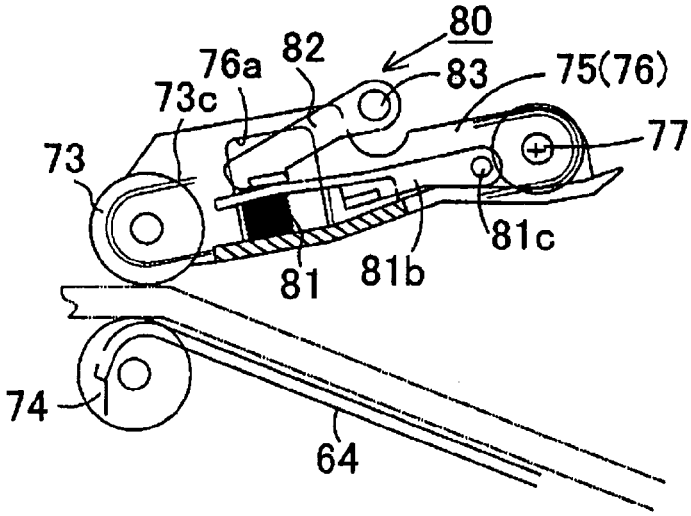
FIG. 6*d* is another explanatory view of the feeding mechanism (when the feeding mechanism is in an operation position) according to the invention.
Figure 6E:
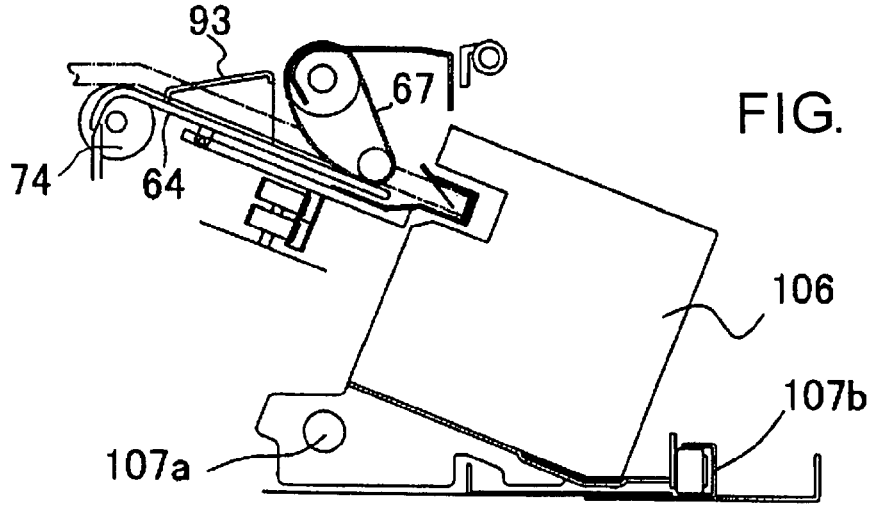
FIG. 6*e* is a cross-sectional view showing a structure of transport means and a post-processing apparatus.
Figure 7:
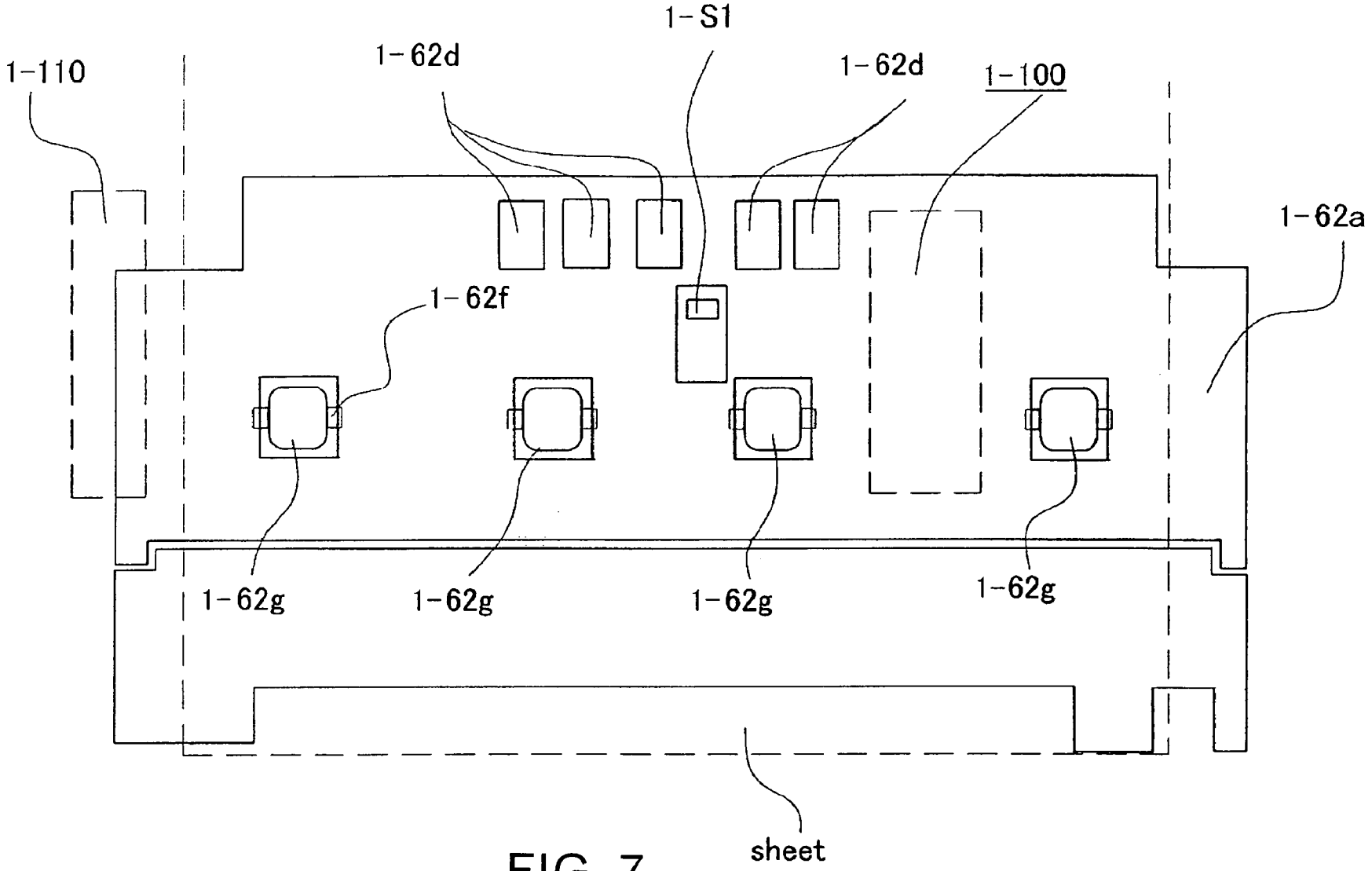
FIG. 7 is a structural view of a guide plate.

A driving mechanism will be described below. As shown in FIG. 6*a*, the right and left side frames 1-60*a* constituting the unit frame are coupled to the driving axis 1-69*c* that revolves the ejection rollers 1-69, an axis 1-62*e* that revolves the feeding roller 1-62*b* (driving-side roller), a revolving axis 1-77 of the driving rollers 1-73, and the rotation supporting axis 1-83 of the pressurizing lever 1-82. Single (independent) pressurizing motor 1-M4 is coupled to the rotation supporting axis 1-83 via the section-shaped gear 1-85, and controlling the pulse for the pressurizing motor 1-M4 causes the pressurizing lever 1-82 to move downward to come into press-contact with sheets or upward to be spaced from the sheets. The axis 1-62*e* and driving axis 1-69*c* are coupled to a first feeding motor 1-M1, and revolve the feeding roller 1-62*b* (driving-side roller) in the unit ejecting path 1-62, the driving-side ejection roller 1-69*a* and caterpillar belt 1-67 each in the direction of feeding the sheet.

In the driving rollers 1-73, the second feeding motor 1-M2 is coupled to the revolving axis 1-77, and the revolving axis 1-77 and driving rollers 1-73 are coupled with the conveyance belt 1-73 to revolve. The second feeding motor 1-M2 is comprised of a forward/reverse rotatable motor, feeds a sheet fed from the unit ejecting path 1-62 in the ejecting direction, and then, after the rear end of the sheet arrives at the processing tray 1-64, rotates in the reverse direction to feed in the inverse direction until the rear end of the sheet reaches the positioning means 1-65.

The post-processing apparatus 1-100 has the cam driving motor 1-M5 (not shown) incorporated into the housing 1-106, and is designed to travel along the guide rail 1-107 by the unit moving motor 1-M3 as described previously. The right and left aligning plates 1-93*a* and 1-93*b* constituting the aligning means 1-91 are respectively coupled to the aligning motors 1-M6*a* and 1-M6*b* independent of each other via the pinions 1-94 and racks 1-95.

Described next is control of the finisher unit 1-C. To the control CPU 1-90 is conveyed a mode instruction signal for post-processing, a signal (post-processing starting signal) indicative of finish of ejection of a series of sheets (targeted for post-processing), and a signal (size signal) indicative of a sheet size from the image formation unit 1-A. Further, to the control CPU 1-90 are conveyed a signal of an entrance sensor 1-S1 which is provided in the unit ejecting path 1-62 and detects a front end and rear end of a sheet, a signal of a level sensor 1-S3 of the collection tray 1-112, a signal of a position sensor of the aligning means 1-91, a signal of the position sensor of the section-shaped gear 1-85 to which is attached the rotation supporting axis 1-83 of the pressurizing lever 1-82, and a signal of the position sensor of the post-processing apparatus 1-100.

Meanwhile, the control CPU 1-90 is connected to output control signals to a driving circuit for the first feeding motor 1-M1 and second feeding motor 1-M2, a driving circuit for the aligning motors 1-M6*a* and 1-M6*b* of the aligning plate 1-91, the unit moving motor 1-M3 of the post-processing apparatus 1-100, a driving circuit for the cam driving motor 1-M5, a driving motor for the cooling fan 1-110, and a driving circuit for the pressuring motor 1-M4 coupled to the pressurizing lever 1-82.

Each operation will be described below. In the finisher unit 1-C as described above, the control CPU 1-90 generating control signals of the unit 1-C executes each operation as described below. First, upon receiving an instruction signal indicative of ejection of sheets from the image formation unit 1-A, the control CPU 1-90 starts the first feeding motor 1-M1 to move the feeding roller 1-62*b* (driving-side roller), ejection roller 1-69*a* and caterpillar belt 1-67 (transport means) coupled thereto in the sheet ejecting direction. At the same time, the control CPU 1-90 rotates the driving motor for the cooling fan 1-110 to start sending air, while controlling the unit moving motor 1-M3 of the post-processing apparatus 1-100 to position the post-processing apparatus 1-100 at a predetermined position. In order to change the direction of air from the cooling fan 1-110 toward the guide plate 1-62*a* of the unit ejecting path 1-62, with respect to the post-processing apparatus 1-100 as shown in the figure, the predetermined position is set beforehand at X-X in the sheet width direction in the figure.

FIG. 8 shows such states. Z-Z in FIG. 8 represents the time of staring the apparatus, where the post-processing apparatus 1-100 is located at the home position. X-X represents the state where the apparatus moves to the predetermined position where the air sent from the cooling fan 1-110 hits the housing 1-106, is changed in direction, thereby sending the cold air to the guide plate 1-62*a* of the unit ejecting path 1-62 situated above the housing 1-106, and thus cools the sheet from the air vents 1-62*d*. The control CPU 1-90 performs such control by outputting as an instruction signal the number of power supply pulses to supply to the driving circuit of the unit moving motor 1-M3 of the post-processing apparatus 1-100, and the number of pulses is set in advance. In addition, Y-Y in FIG. 8 indicates a position to perform post-processing on sheets.

Next, the control CPU 1-90 obtains the size signal from the image formation unit 1-A, and drives the aligning motors 1-M6*a* and 1-M6*b* of the aligning means 1-91. The aligning motors 1-M6*a* and 1-M6*b* move the right and left aligning plates 1-93*a* and 1-93*b* to standby positions with a distance slightly larger than a size of the width of fed sheets. The aligning motors 1-M6*a* and 1-M6*b* are controlled by supplying thereto power supply pulses set to move the right and left aligning plates 1-93*a* and 1-93*b* from the home positions to standby positions set beforehand corresponding to the sheet size, respectively.

Then, the control CPU 1-90 obtains a sheet rear end detection signal from the entrance sensor S1 of the unit ejecting path 1-62, and after a lapse of estimated time the sheet arrives at the processing tray 1-64, moves the driving rollers 1-73 from the withdrawal position to the operation position. This control is performed by rotating counterclockwise in FIG. 3 the pressurizing motor 1-M4 coupled to the rotation supporting axis 1-83 of the pressurizing lever 1-82. An amount of the rotation is set in advance such that the sufficient feeding force is applied to deliver a bundle of sheets on the processing tray 1-64. The rotation of the pressurizing motor 1-M4 swings the pressurizing lever 1-82 counterclockwise in FIG. 3, and the front end of the lever presses the force-storing spring 1-81 down, thereby pressing the driving rollers 1-73. After the driving rollers 1-73 are pressed down to the operation position from the withdrawal position, the control CPU 1-90 revolves the second feeding motor 1-M2. Then, the sheets fed to the processing tray 1-64 are inversed in direction, and fed from the rear end side to the positioning means 1-65 on the processing tray 1-64 by the driving rollers 1-73.

The control CPU 1-90 stops the second feeding motor 1-M2 after a lapse of estimated time the rear ends of the sheets reach the positioning means 1-65. Concurrently, the control CPU 1-90 rotates reversely the operation motor 1-M4 of the pressurizing lever 1-82 to move the driving rollers 1-73 to the withdrawal position, and then stops.

Thus, after sheets are fed to a predetermined position on the processing tray 1-64, the control CPU 1-90 executes the next operation to align the sheets. In other words, after a lapse of estimated time the sheets arrive at the positioning means 1-65 obtained from the sheet rear end detection signal from the entrance sensor 1-S1, the control CPU 1-90 drives the aligning motors 1-M6*a* and 1-M6*b* by a predetermined amount to move the right and left aligning plates 1-93*a* and 1-93*b* by a predetermined amount with respect to the center of the sheet. The sheets fed and placed on the processing tray 1-64 are aligned in right and left edges by the aligning plates 1-93 and arranged.

To control the aligning motors 1-M6*a* and 1-M6*b*, the control CPU 1-90 outputs a number of power supply pulses to the driving circuit such that the plates reciprocate between the standby position and aligning position (strokes are predetermined corresponding to width sizes of sheets.) Thus, after a series of sheets is fed successively, upon receiving a finish signal of image formation from the image formation unit 1-A, the control CUP 1-90 performs control to start the unit moving motor 1-M3 of the post-processing apparatus 1-100. At the same time, the control CPU 1-90 stops the first feeding motor 1-M1 and second feeding motor 1-M2. The post-processing apparatus 1-100 as shown in the figures is comprised of a stapler, and is moved to a position set beforehand corresponding to the processing mode signal output from the image formation unit 1-A.

As described above, the operation for feeding sheets and then aligning is repeated, and when a series of sheets from the image formation unit 1-A is mounted on the processing tray 1-64, the control CPU 1-90 receives the finish signal of image formation from the image formation unit 1-A and executes the post-processing. As processing modes of the stapler in the figure, positions are predetermined for two-central position stapling, corner stapling and other stapling. In two-central position stapling, the control CPU 1-90 controls the motor 1-M3 to move the post-processing apparatus 1-100 to a first position (Y-Y in FIG. 8) calculated corresponding to the sheet size, and outputs an instruction signal of execution of the processing to the post-processing apparatus 1-100 to execute the processing. After completion of the processing, the control CPU 1-90 moves again the post-processing apparatus 1-100 to a next position (X-X in FIG. 8), and outputs a signal of execution of the processing. The unit moving motor 1-M3 of the post-processing apparatus 1-100 moves the post-processing apparatus 1-100 to a predetermined position by an amount of rotation in the rotation direction respectively based on the pulse-number instruction signal and on a command signal both output from the control CPU 1-90.

After finishing the post-processing operation as described above, the control CPU 1-90 feeds the processed sheets on the processing tray 1-64 to the collection tray 1-112. First, the control CPU 1-90 sets the number of revolutions of the motor at this time so as to apply a predetermined circumferential velocity to the driving rollers 1-73, and the rotation of the driving rollers 1-73 feeds the sheets nipped with the pinch roller 1-74 toward the collection tray 1-112.

Next, immediately before the time the rear ends of the sheets reach the roller position calculated from the distance between the position of the driving rollers 1-73 and positioning means 1-65 at the rear ends of the sheets, the control CPU 1-90 reduces the rotation speed of the second feeding motor 1-M2 to the second speed, and concurrently, reduces the pressing force of the pressurizing lever 1-82. This is because of reducing the speed and pressing force (nipping force between the driving and following rollers) to prevent the rear ends of sheets from collapsing when the rear ends of sheets leave from the driving rollers 1-73.

Figure 11:
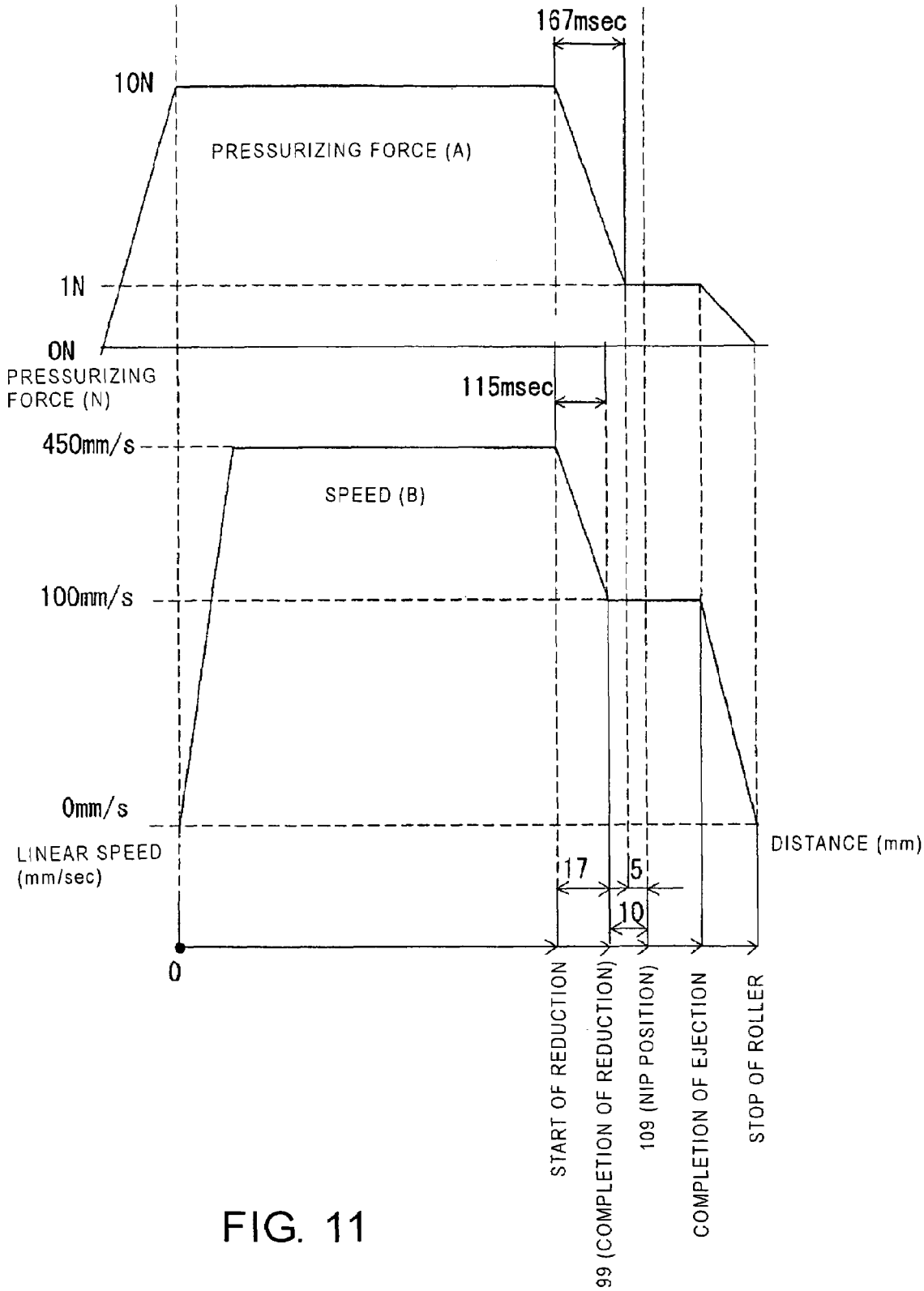
FIG. 11 is chart showing timing of control according to the invention where (A) represents pressurizing force applied by the pressurizing lever and (B) represents a circumferential velocity of driving rollers.
Figure 12:
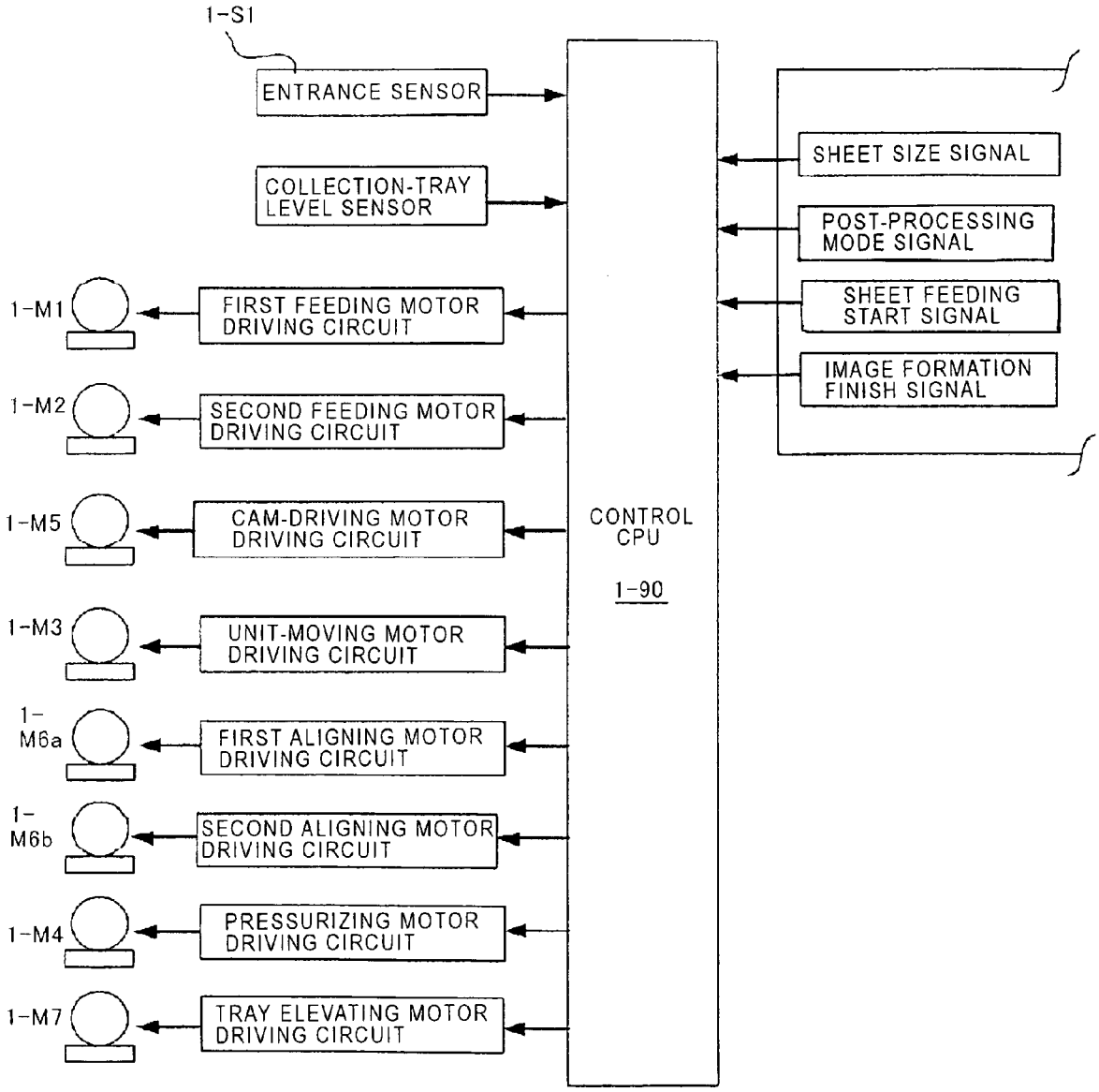
FIG. 12 is a block diagram illustrating control of the finisher unit.

FIG. 11 illustrates timing of the control. (A) in FIG. 8 represents the pressurizing force applied by the pressurizing lever 1-82, and (B) in FIG. 11 represents the circumferential velocity of the driving rollers 1-73. Upon receiving an instruction signal for sheet feeding (for example, operation finish signal of the post-processing apparatus), the control CPU 1-90 drives the pressurizing motor 1-M4, moves the driving rollers 1-73 to the operation position to come into contact with the sheets by the pressurizing lever 1-82, and sets the force applied to the sheets, for example, at 10N. After this operation, the CPU 1-90 stops the pressurizing motor 1-M4, and the pressurizing lever 1-82 applies the constant pressing force (10N) to the driving rollers 1-73. Next, the control CPU 1-90 starts the second feeding motor 1-M2 to drive the driving rollers 1-73 at the first circumferential velocity of 450 mm/s. Then, the sheets on the processing tray 1-64 are nipped by the driving rollers 1-73 and pinch roller 1-74 and fed toward the collection tray 1-112.

Immediately before rear ends of thus fed sheets reach the position of driving rollers 1-73 (80 mm to 100 mm in the figure), the control CPU 1-90 rotates the pressurizing motor 1-M4 by a predetermined amount in reverse direction (clockwise in FIG. 3), and raises the pressurizing lever 1-82 to a position such that the pressing force applied to the driving rollers 1-73 by the pressurizing lever 1-82 is reduced at substantially one-ninth (the pressing force in the figure is 1N.) Then, the bundle of sheets is nipped by weak force between the driving rollers 1-73 and pinch roller 1-74, and fed out by the rotation of the driving rollers 1-73. At this point, before reducing the pressing force, the control CPU 1-90 controls the second feeding motor 1-M2 to reduce the circumferential velocity of the driving rollers 1-73 to substantially one-fourth or one-fifth (100 mm/s in the figure).

The reason why the pressing force of the driving rollers 1-73 is thus reduced after reducing the feeding speed is preventing occurrences of a slip between the sheets and rollers. By thus controlling, the bundle of sheets on the processing tray 1-64 undergo the reduced pressing force when leaving from the driving rollers 1-73, the feeding speed is also reduced, and the bundle is gently stored on the collection tray 1-112. After feeding the sheets, when the control CPU 1-90 rotates the pressurizing motor 1-M4 in the inverse direction (clockwise in FIG. 3), the engaging piece 1-82*a* of the pressurizing lever 1-82 is engaged in the upper wall of the engaging groove 1-76*a* of the arm member 1-76, thereby raising the arm member 1-76, and the driving rollers 1-73 are withdrawn to the withdrawal position. After stopping the pressurizing motor 1-M4, the rollers are kept at the position by detent torque of the motor while preparing for next sheet ejection operation.

Descriptions of the Second Embodiment of the Invention

Figure 13:
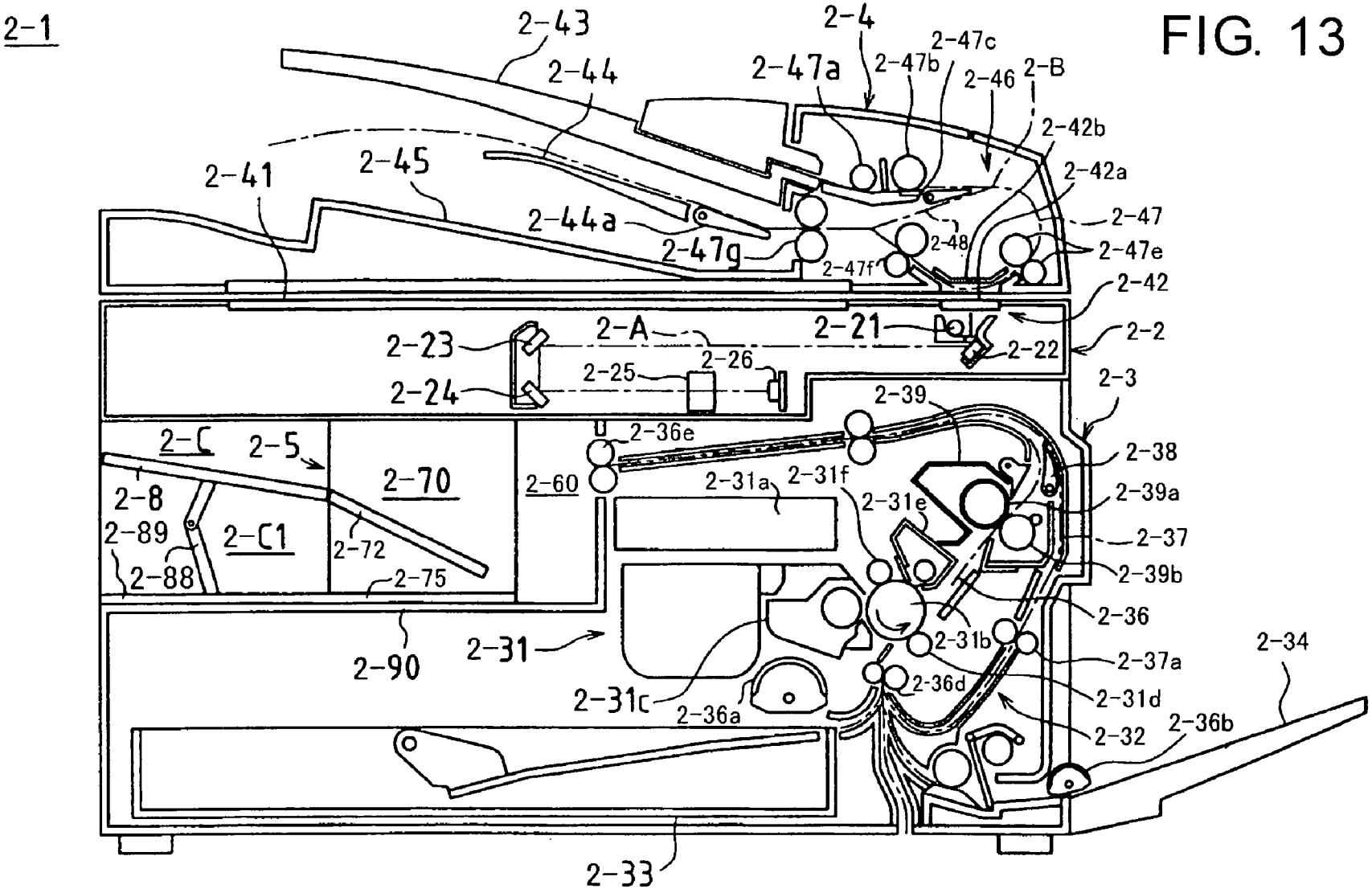
FIG. 13 is a view showing a schematic structure of an image formation apparatus to which the invention is applied.

FIG. 13 illustrates an image formation apparatus 2-1 according to the second embodiment of the invention. In FIG. 13, the image formation apparatus 2-1 is provided with a scanner section 2-2 as original scanning means, image formation section 2-3, original automatic feeding section 2-4, and sheet post-processing section (sheet post-processing apparatus as described the claims) 2-5 as sheet post-processing means. In addition, in following descriptions, the image formation apparatus 2-1 except the sheet post-processing section 2-5 and an output tray 2-8 is referred to as "apparatus body" as appropriate.

The image formation apparatus 2-1 has a copy mode, printer mode and FAX mode as image formation modes to form an image on a recording sheet (including recording media such as OHP), and a user selects each mode. Described below are first, each section of the image formation apparatus 2-1, and second, the peripheral structure and the processing in operation of the sheet post-processing apparatus according to the present invention.

The scanner section 2-2 is a part to read an image of an original mounted on an original mount 2-41 comprised of transparent glass or the like or an image of an original fed on a sheet basis by the original automatic feeding section 2-4 to generate image data of the original. The scanner section 2-2 is provided with an exposure light source 2-21, a plurality of reflecting mirrors 2-22, 2-23 and 2-24, image-forming lens 2-25 and photoelectric conversion element (such as CCD; Charge Coupled Device) 2-26.

The exposure light source 2-21 emits light to the original mounted on the original mount 2-41 of the original automatic feeding section 2-4 or the original fed in the original automatic feeding section 2-4. As shown by alternate long and short dashed lines 2-A in FIG. 13, the reflecting mirrors 2-22, 2-23 and 2-24 are configured to once reflect the reflected light from the original to the left, reflect the light downward and then reflect the light to the right toward the image-forming lens 2-25, as viewed in FIG. 3.

The image reading operation of the original includes following two types. When an original placed on the original mount 2-41 is read (in the case of using as a "sheet fixing type"), the exposure light source 2-21 and each of the reflecting mirrors 2-22, 2-23 and 2-24 scan in the horizontal direction along the original mount 2-41 to read an image of entire the original. Meanwhile, when an original fed in the original automatic feeding section 2-4 is read (in the case of using as a "sheet moving type"), the exposure light source 2-21 and each of the reflecting mirrors 2-22, 2-23 and 2-24 are fixed to respective positions as shown in FIG. 13, and read an image of the original when the original is passed through an original reading section 2-42 of the original automatic feeding section 2-4.

The light which is reflected by each of the reflecting mirrors 2-22, 2-23 and 2-24 and passed through the image-forming lens 2-25 is guided to the CCD 2-26, and the reflected light is converted into an electrical signal (image data of the original) in the CCD 2-26.

The image formation section 2-3 is provided with an image formation system 2-31 as printing means, and sheet feeding system 2-32. The image formation system 2-31 is provided with a laser scanning unit 2-31*a* and a photosensitive drum 2-31*b* as a drum-shaped image supporting member. The laser scanning unit 2-31*a* emits a laser beam based on the image data of the original converted in the CCD 2-26 or image data input from an external terminal apparatus or the like to the surface of the photosensitive drum 2-31*b*. The photosensitive drum 2-31*b* forms an electromagnetic latent image on the surface thereof by being irradiated with the laser beam from the laser scanning unit 2-31*a* while rotating in the direction shown by the arrow in FIG. 13. Further, around the periphery of the photosensitive drum 2-31*b* are provided, as well as the laser scanning unit 2-31*a*, a developing unit (developing mechanism) 2-31*c*, a transfer unit (transfer mechanism) not shown having a transfer roller 2-31*d*, cleaning unit (cleaning mechanism) 2-31*e*, static eliminator not shown, and charge unit (charge mechanism) not shown having a charge roller 2-31*f* in the circumference direction.

The developing unit 2-31*c* develops the electrostatic latent image formed on the surface of the photosensitive drum 2-31*b* to a visible image by toner (image-exhibiting substance). The transfer roller 2-31*d* transfers the toner image formed on the surface of the photosensitive drum 2-31*b* to a recording sheet as a recording medium. The cleaning unit 2-31*e* removes the toner remaining on the surface of the photosensitive drum 2-31*b* after transferring the toner. The static eliminator eliminates residual charge on the surface of the photosensitive drum 2-31*b*. The charge roller 2-31*f* charges the surface of the photosensitive drum 2-31*b* before forming the electrostatic latent image to a predetermined potential.

Meanwhile, the sheet feeding system 2-32 feeds on a sheet basis a recording sheet stored in a sheet cassette 2-33 as paper feeding means or a recording sheet mounted on a manual feeder tray 2-34 to cause the image formation system 2-31 to form an image, while ejecting the recording sheet with the image formed thereon to an output tray 2-8 as paper ejecting means via the sheet post-processing section 2-5 described later. The output tray 2-8 is provided above the sheet cassette 2-33 and under the scanner section 2-2. The output tray 2-8 will specifically be described later.

Figure 14:
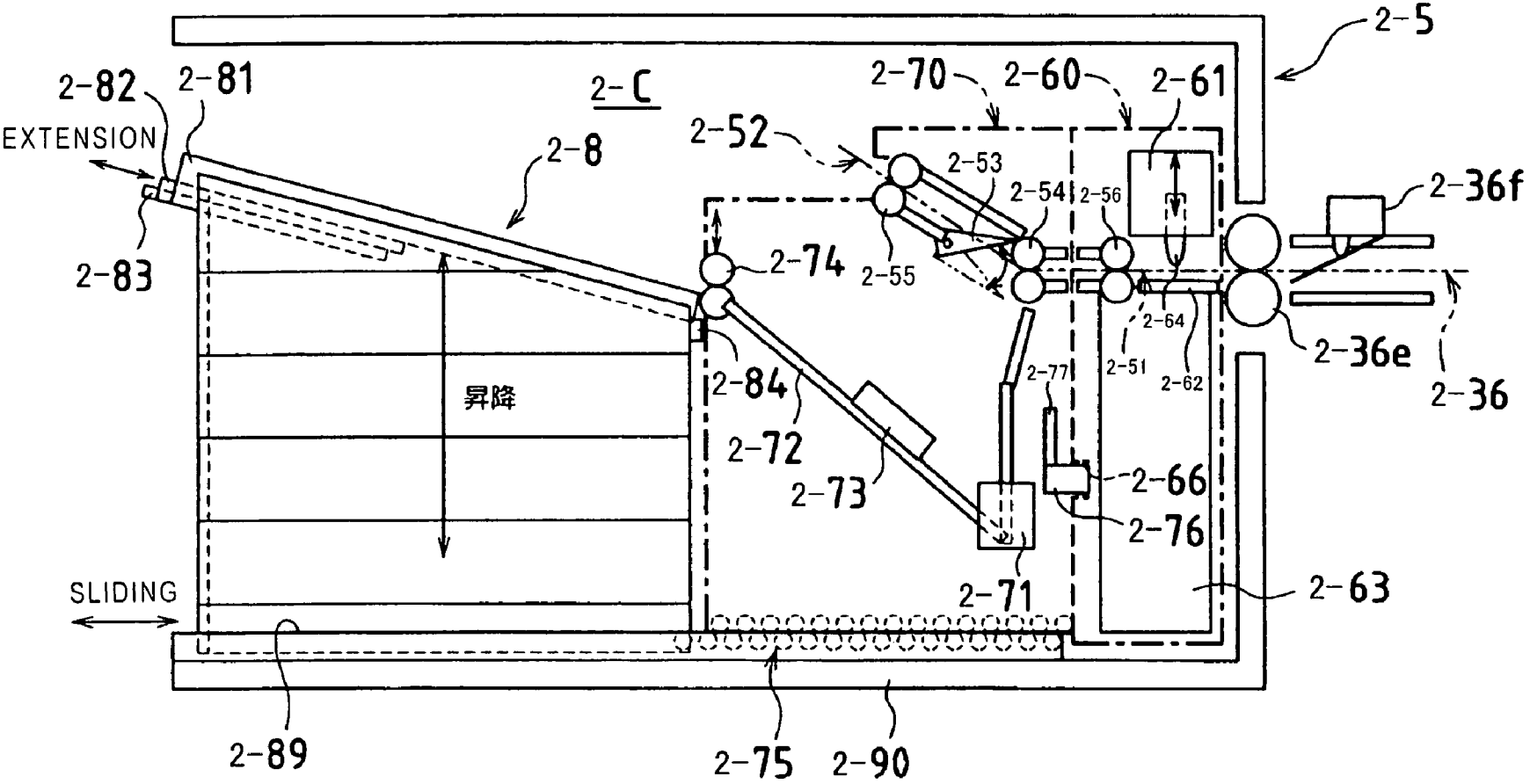
FIG. 14 is a view showing a schematic structure of a sheet post-processing section and output tray.

The sheet feeding system 2-32 is provided with a main feeding path 2-36 and an inverse feeding path 2-37 in the apparatus body, and a main feeding path 2-51 and a switch-back feeding path 2-52 in the sheet post-processing section 2-5 as shown in FIG. 14. The main feeding path 2-36 in the apparatus body and main feeding path 2-51 in the sheet post-processing section 2-5 are connected via an ejection roller 2-36*e* of the apparatus body as a boundary.

The main feeding path 2-36 of the apparatus body is branched at one end side to two paths, and one of branched ends is opposed to the ejection side of the sheet cassette 2-33, while the other branched end is opposed to the ejection side of the manual feeder tray 2-34. Further, the main feeding path 2-36 is opposed at the other end side to a punching unit 2-60 of the sheet post-processing section 2-5. The inverse feeding path 2-37 is connected at one end side to the main feeding path 2-36 at the upstream side (lower side in FIG. 13) from an installation position of the transfer roller 2-31*d*, while being connected at the other end side to the main feeding path 2-36 at the downstream side (upper side in FIG. 13) from the installation position of the transfer roller 2-31*d*.

A semicircular cross-section pickup roller 2-36*a* is provided at one branched end (portion opposite to the ejection side of the sheet cassette 2-33) of the main feeding path 2-36. Similarly, a semicircular cross-section pickup roller 2-36*b* is provided at the other branched end (portion opposite to the ejection side of the manual feeder tray 2-34) of the main feeding path 2-36.

A register roller 2-36*d* is provided at the upstream side from the installation position of the transfer roller 2-31*d* in the main feeding path 2-36. The register roller 2-36*d* feeds the recording paper while registering the toner image on the photosensitive drum 2-31*b* and the recording paper.

At the downstream side from the installation position of the transfer roller 2-31*d* in the main feeding path 2-36, a fusing unit 2-39 is provided which has a pair of heating rollers 2-39*a* to fuse the toner image transferred to the recording sheet by heating, and pressurizing roller 2-39*b*. Further, at the downstream end of the main feeding path 2-36, the ejection roller 2-36*e* to eject the recording sheet to the sheet post-processing section 2-5 is provided at the boundary with the main feeding path 2-51 of the sheet post-processing section 2-5.

A branch nail 2-38 is provided at a connection position of the inverse feeding path 2-37 with the main feeding path 2-36 at the upstream end of the path 2-37. The branch nail 2-38 is rotatable around the horizontal axis between a first position (shown by solid line) in FIG. 13 and a second position rotated counterclockwise from the first position in FIG. 13 where the inverse feeding path 2-37 is released. When the branch nail 2-38 is in the first position, the recording sheet is fed toward the main feeding path 2-51 of the sheet post-processing section 2-5. When the nail 2-38 is in the second position, it is possible to feed the recording sheet to the inverse feeding path 2-37.

The inverse feeding path 2-37 is provided with a feeding roller 2-37*a*. When a recording sheet switched back by the switch-back feeding path 2-52 in the sheet post-processing section 2-5 is fed to the inverse feeding path 2-37, the feeding roller 2-37*a* feeds the recording sheet, and the recoding sheet is thereby guided to the main feeding path 2-36 at the upstream side of the register roller 2-36*d*, and fed toward again the transfer roller 2-31*d* in the main feeding path 2-36. In other words, it is possible to form an image on the backside of the recording sheet.

The original automatic feeding section 2-4 is configured as the so-called automatic both-side original feeding apparatus. The original automatic feeding section 2-4 is usable as the sheet moving type, and provided with an original tray 2-43 as a mount of an original, middle tray 2-44, original output tray 2-45 as an original ejecting section, and original feeding system 46 that feeds the original among trays 2-43, 2-44 and 2-45.

The original feeding system 2-46 is provided with a main feeding path 2-47 to feed an original mounted on the original tray 2-43 to the middle tray 2-44 or original output tray 2-45 via the original reading section 2-42, and a sub-feeding path 2-48 to feed the original on the middle tray 2-44 to the main feeding path 2-47.

At the upstream end (portion opposite to the ejection side of the original tray 2-43) of the main feeding path 2-47 are provided an original pickup roller 2-47*a* and a separating roller 2-47*b*. Under the separating roller 2-47*b* is provided a separating plate 2-47*c*. In response to rotation of the original pickup roller 2-47*a*, one of originals on the original tray 2-43 is fed to the main feeding path 2-47 while being passed through the separating roller 2-47*b* and separating plate 2-47*c*. PS rollers 2-47*e* are provided at the downstream side from a merging portion (portion of 2-B in FIG. 13) of the main feeding path 2-47 and sub-feeding path 2-48. The PS rollers 2-47*e* are to adjust the front end of the original and image reading timing to supply the original to the original reading section 2-42. In other words, the PS rollers 2-47*e* once stop the feeding of the original with the original fed, adjust the timing as described above, and feed the original to the original reading section 2-42.

The original reading section 2-42 is provided with a platen glass 2-42*a* and original pressing plate 2-42*b*, where light from the exposure light source 2-21 is applied to the original via the platen glass 2-42*a* during the time the original supplied from the PS rollers 2-47*e* is passed through between the platen glass 2-42*a* and original pressing plate 2-42*b*.

At the downstream side of the platen glass 2-42*a* is provided a feeding roller 2-47*f* and original ejection rollers 2-47*g*. The original passed on the platen glass 2-42*a* is fed to the middle tray 2-44 or original output tray 2-45 via the feeding roller 2-47*f* and original ejection rollers 2-47*g*.

A middle tray swinging plate 2-44*a* is provided between the original ejection rollers 2-47*g* and middle tray 2-44. The middle tray swinging plate 2-44*a* has a swing center at an end portion on the middle tray 2-44 side, and is able to swing between a position 2-1 (position shown by solid line) and a position 2-2 bounced upward from the position 2-1. When the middle tray swinging plate 2-44*g* is in the position 2-2, the original ejected from the original ejection rollers 2-47*g* is collected in the original output tray 2-45. Meanwhile, when the middle tray swinging plate 2-44*g* is in the position 2-1, the original ejected from the original ejection rollers 2-47*g* is ejected to the middle tray 2-44. When the original is ejected to the middle tray 2-44, an end edge of the original is pinched between the original ejection rollers 2-47*g*. By the original ejection rollers 2-47*g* rotating reversely from this state, the original is fed to the sub-feeding path 2-48, and fed again to the main feeding path 2-47 via the sub-feeding path 2-48. The reverse rotation operation of the original ejection rollers 2-47*g* is carried out by adjusting the feeding of the original to the main feeding path 2-47 and the timing of image reading. An image on the backside of the original is thus read by the original reading section 2-42.

The sheet post-processing section 2-5 enables recording sheets ejected from the apparatus body after the printing processing is finished to undergo a plurality of sheet post-processing such as punching processing, stapling processing and the like. Such sheet post-processing in the sheet post-processing section 2-5 is performed when the sheet post-processing is requested as printing conditions in the printing request.

In this example, the sheet post-processing section 2-5 and output tray 2-8 are installed using space 2-C formed by the apparatus body, instead of being installed outside the apparatus body of the image formation apparatus 2-1. More specifically, in the apparatus body of the image formation apparatus 2-1, the sheet cassette 2-33, image formation section 2-3 (image formation system 2-31) and scanner section 2-2 are configured substantially in the shape of a "U". The sheet post-processing section 2-5 and output tray 2-8 are installed inside the U-shaped space 2C formed by the apparatus body. It is thus possible to install the sheet post-processing section 2-5 and output tray 2-8 in the limited space inside the image formation apparatus 2-1, and to perform a plurality of sheet post-processing on recording sheets. Further, it is possible to a reduce an occupied area of the image formation apparatus 2-1 provided with the sheet post-processing section 2-5, and obtain space savings.

The sheet post-processing section 2-5 and output tray 2-8 will specifically be described below with reference to FIGS. 14 to 21. In addition, a direction (the direction shown in FIG. 15) in which a recording sheet is fed is referred to as a "sheet feeding direction", while a direction (direction shown in FIG. 15) of the width of a recording sheet, perpendicular to the sheet feeding direction, is referred to as a "sheet width direction".

As shown in FIG. 14, the sheet post-processing section 2-5 is disposed on the downstream side of the ejection roller 2-36*e* of the apparatus body. The sheet post-processing section 2-5 is provided with, as sheet post-processing units, the punching unit 2-60 with the function of punching a hole, and a stapling unit 2-70 with the stapling function. A front face (face on the front side) of the sheet post-processing section 2-5 is covered with an openable/closable cover 2-50. In the sheet post-processing section 2-5, the punching unit 2-60 is disposed on the upstream side, while the stapling unit 2-70 is disposed on the downstream side. The output tray 2-8 is provided on the downstream side of the sheet post-processing section 2-5. A recording sheet ejected from the ejection roller 2-36*e* is ejected to the output tray 2-8 via the punching unit 2-60 and stapling unit 2-70. The output tray 2-8 is used as a sheet receiving portion for the stapling processing when the stapling unit 2-70 of the sheet post-processing section 2-5 performs the stapling processing.

The punching unit 2-60 performs processing (punching processing) of punching a hole on the recording sheet ejected from the ejection roller 2-36*e*. The punching unit 2-60 is provided with a punching mechanism section 2-61, guide plate 2-62, punch dust storage box 2-63 and the like. The main feeding path 2-51 is formed as the sheet feeding system 2-32 as described previously. In the punching unit 2-60, a feeding roller 2-56 is provided at some midpoint in the main feeding path 2-51. In addition, the punching unit 2-60 is fixed to the apparatus body, differing from the stapling unit 2-70 described later.

When a request is made for the punching processing as printing conditions in the printing request, the punching unit 2-60 stops the recording sheet fed to the punching unit 2-60 on the guide plate 2-62, and punches a hole on a sheet basis by the punching mechanism section 2-61. At this point, the hole is punched at a position determined based on the printed sheet size.

The punching mechanism section 2-61 is disposed in the upper portion of the punching unit 2-60, and is provided with two core members 2-64 in accordance with a diameter of a punch hole at a predetermined interval along the sheet width direction. The core members 2-64 are provided to be movable upward and downward, and when moving down, punch holes in the recording sheet. Further, the core members 2-64 are provided to enable reciprocating travel both in the direction along the sheet feeding direction and in the direction along the sheet width direction, and allowed to make register in performing the punching processing.

The guide plate 2-62 is disposed under the punching mechanism section 2-61, and provided with openings corresponding to predetermined positions to punch holes. The punch dust storage box 2-63 is disposed in the lower portion of the punching unit 2-60, and collects punch dust caused by the punching processing. The punch dust storage box 2-63 is provided to be slidable along the sheet width direction, and as described later, can be taken out forward when the cover 2-50 is opened. It is thus possible to remove the punch dust stored in the punch dust storage box 2-63.

When the punching processing is performed in the punching unit 2-60, the core members 2-64 of punching mechanism section 2-61 are moved to positions corresponding to positions determined based on the printed sheet size as described previously.

In addition, to enable punch holes to be opened accurately at the positions determined based on the printed sheet size, fine moving adjustments are made to the core members 2-64 of the punching mechanism section 2-61 of the punching unit 2-60, but descriptions of the fine moving adjustments are omitted.

The stapling unit 2-70 performs the stapling processing on the sheet fed from the punching unit 2-60 at the upstream side. The stapling unit 2-70 is provided to be slidable in the direction along the sheet feeding direction when the cover 2-50 is upwardly opened toward the front. Further, the stapling unit 2-70 is provided to enable engagement and disengagement with respect to the punching unit 2-60 disposed upstream of the stapling unit 2-70.

The stapling unit 2-70 is provided with a stapling mechanism section 2-71, stapling bench 2-72, aligning plates 2-73, ejection rollers 2-74 and like. Further, formed as the sheet feeding system 2-32 are the main feeding path 2-51 and switch-back feeding path 2-52. The stapling unit 2-70 is further provided with a branch nail 2-53 that switches between directions to guide the recording sheet, and an ejection roller 2-54 that ejects the recording sheet to the stapling bench 2-72 at a connection position of the downstream side of the main feeding path 2-51 and the upstream side of the switch-back feeding path 2-52. A switch-back roller 2-55 is provided at the downstream side of the switch-back feeding path 2-52.

In the stapling unit 2-70, when the stapling processing is requested as printing conditions in the printing request, the stapling mechanism section 2-71 performs the stapling processing on a predetermined number of recording sheets mounted on the stapling bench 2-72. At this point, the stapling processing is performed at a position determined based on the printed sheet size and desired stapling position. The stapling position is position(s) to perform user desired stapling processing, such that, for example, one portion is stapled at a left upper corner of the recording sheet, two portions are stapled at a left end portion, or the like.

The stapling mechanism section 2-71 is disposed under the ejection roller 2-54, and binds rear end portions of the recording sheets mounted on the stapling bench 2-72 with a staple. The stapling mechanism section 2-71 is configured to enable reciprocating travel along the sheet width direction, and is capable of performing the stapling processing at the position determined based on the printed sheet size and desired stapling position as described above. When the stapling unit 2-70 performs the stapling processing, the stapling mechanism section 2-71 is moved to the position determined based on the printed sheet size and desired stapling position.

The stapling bench 2-72 is to mount recording sheets ejected from the ejection roller 2-54, and is a processing bench for the stapling processing by the stapling mechanism section 2-71. The stapling bench 2-72 is disposed while being inclined upward at the downstream side in the sheet feeding direction. When the stapling processing is performed, the recording sheet ejected from the ejection roller 2-52 slides down along the slope of the stapling bench 2-72 by its own weight toward the upstream side in the sheet feeding direction. Meanwhile, when the stapling processing is not performed, the recording sheet is ejected to the output tray 2-8 from the ejection rollers 2-74.

The aligning plates 2-73 are disposed opposite to each other at the opposite sides in the sheet width direction of an upper face (face on which the recording sheet is output) of the stapling bench 2-72. A pair of aligning plates 2-73 are provided to enable reciprocating travel along the sheet width direction. Then, when the stapling unit 2-70 performs the stapling processing, the aligning plates 2-73 are moved along the sheet width direction, and thereby perform alignment in the sheet width direction for each sheet on the recording sheet ejected on the stapling bench 2-72. At this point, the aligning plates 2-73 are moved corresponding to a movable width determined based on the printed sheet size, i.e. the size of a fed recording sheet. The pair of aligning sheets 2-73 can perform the reciprocating travel, for example, by rack/pinion mechanism.

Described below is the travel of the stapling unit 2-70 in the direction along the sheet feeding direction. In this example, the stapling unit 2-70 is configured to reciprocate along the sheet feeding direction together with the output tray 2-8 and a bottom 2-89 under the output tray 2-8.

A slide-type rail 2-75 is provided between the lower portion of the stapling unit 2-70 and an exterior 2-90 of the apparatus body. The slide-type rail 2-75 may be a slide rail using the ball bearing such as Accuride (TM). More specifically, the slide-type rail 2-75 has such a structure that a holding member that holds the ball bearing exists between a rail attached to the lower portion of the stapling unit 2-70 and a rail attached to the exterior 2-90 of the apparatus body. Then, the rail of the stapling unit 2-70 slides relative to the rail of the exterior 2-90 via the ball bearing, thereby enabling smooth sliding of the stapling unit 2-70 relative to the apparatus body.

Figure 19:
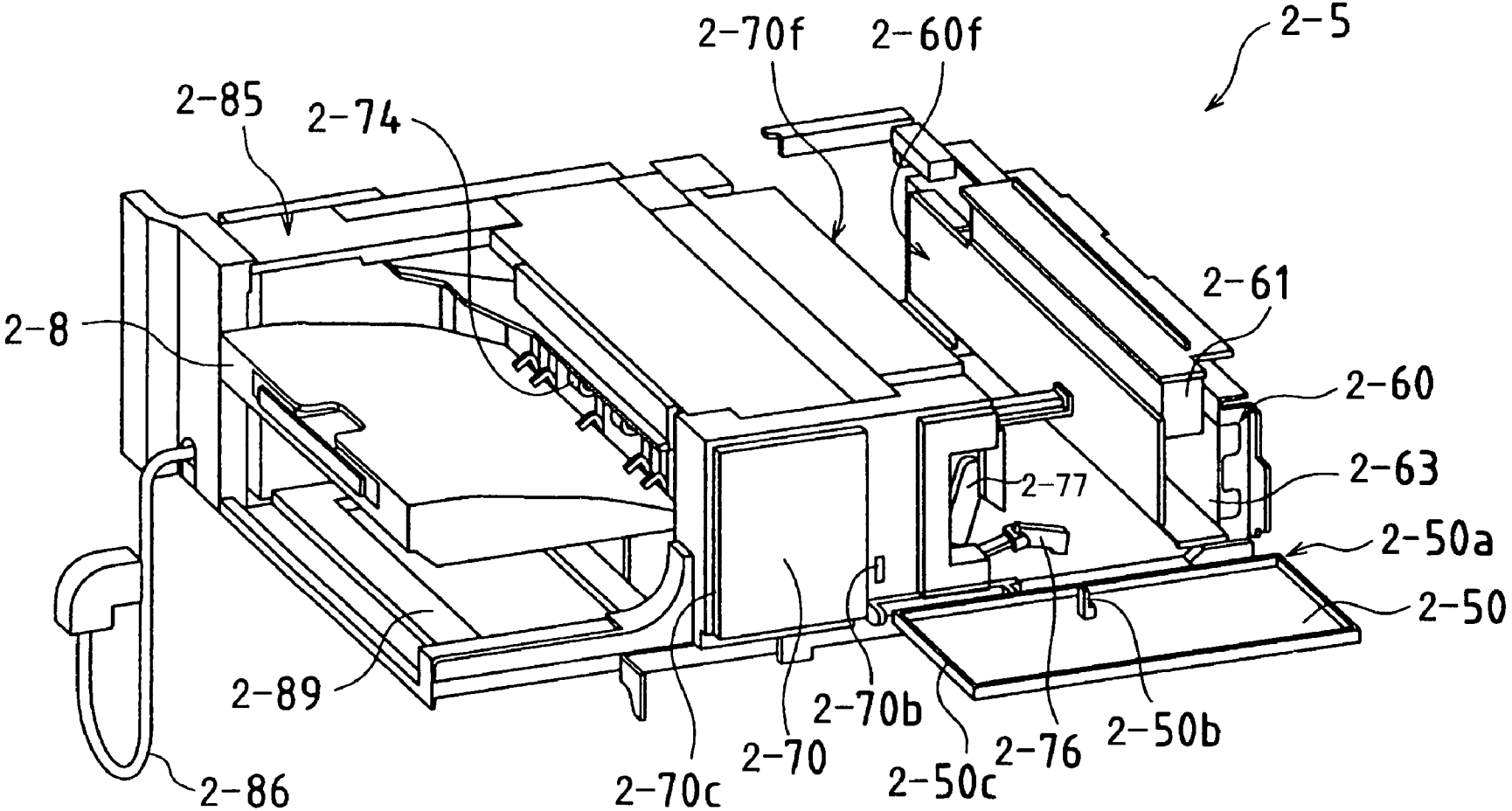
FIG. 19 is a perspective view showing a state with the output tray and stapling unit both slid.

At the ordinary time, the stapling unit 2-70 is disposed to come into contact with the punching unit 2-60 fixed to the apparatus body. Meanwhile, when a jam occurs in the main feeding path 2-51 or switch-back path 2-52, staples are exchanged or refilled, or the like, the stapling unit 2-70 is slid downstream along the sheet feeding direction. By this sliding, as shown in FIG. 19, space is formed between the stapling unit 2-70 and punching unit 2-60. By this means, the visibility is improved, and it is made possible to operate while putting a hand in this space. As a result, it is possible to easily remove the recording sheet jammed in the main feeding path 2-51 or switch-back feeding path 2-5, and thus perform jam handling operation with ease. Further, it is also possible to perform operation of exchanging or filling staples with ease.

At this point, a slidable distance of the stapling unit 2-70 downstream in the sheet feeding direction is maximum a distance such that an end portion of the stapling unit 2-70 at the downstream side in the sheet feeding direction does not protrude from the side face of the image formation apparatus 2-1. In other words, the stapling unit 2-70 is slidable in the range such that the end portion at the downstream side in the sheet feeding direction does not protrude from the apparatus body. By thus providing the slidable range of the stapling unit 2-70 with a limit, the slide-type rail 2-75 is prevented from being deformed or the like.

Figure 20:
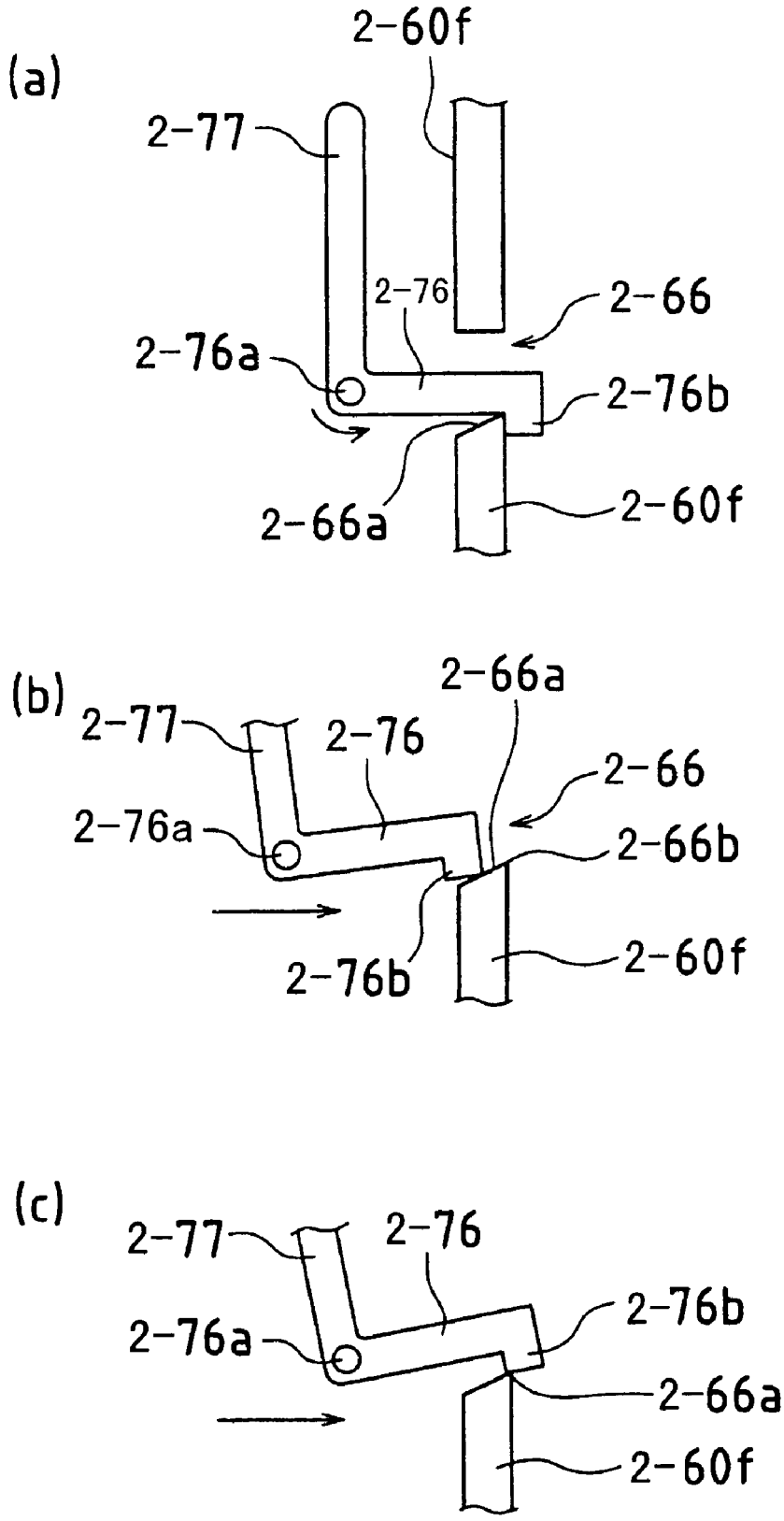
FIG. 20 is an explanatory view illustrating engagement of a hook of the stapling unit and an engagement groove of a punching unit.

As described above, the stapling unit 2-70 is disposed to come into contact with the punching unit 2-60 fixed to the apparatus body at the ordinary time. At this time, as shown in FIG. 20(*a*), the stapling unit 2-70 is fixed to the punching unit 2-60 by a hook 2-76 provided in the stapling unit 2-70 engaging in an engaging groove 2-66 provided in the punching unit 2-60. The hook 2-76 is provided to be rotatable on the rotation support 2-76*a* as a center. Further, the force is applied to the hook 2-76 to rotate clockwise on the rotation support 2-76*a* as a center. A front end portion 2-76*b* of the hook 2-76 is formed substantially in the shape of an "L" to engage in the engaging groove 2-66. Then, the other end of the hook 2-76 is coupled to a lock release lever 2-77.

Following operation is carried out to slide the stapling unit 2-70 to the downstream side in the sheet feeding direction. The hook lever 2-77 is operated to rotate the hook 2-76 counterclockwise on the rotation support 2-76*a* as a center against the applied force, and engagement of the hook 2-76 and engaging groove 2-66 is thereby released. It is thus possible to move the stapling unit 2-70 to the downstream side in the sheet feeding direction. By moving the stapling unit 2-70 to the downstream side in the sheet feeding direction, it is possible to perform the jam handling operation, staple exchange/refill operation and the like with ease, as described above.

On the other hand, following operation is performed to fix the stapling unit 2-70 to the punching unit 2-60 after finishing the jam handling operation, staple exchange/refill operation or the like. When the stapling unit 2-70 is slid to the upstream side in the sheet feeding direction to close to the punching unit 2-60, as shown in FIG. 20(*b*), the front end portion 2-76*b* comes into contact with a slope 2-66*a* of the engaging groove 2-66. By further sliding the stapling unit 2-70 to the upstream side in the sheet feeding direction from this state, as shown in FIG. 20(*c*), the hook 2-76 rotates counterclockwise on the rotation support 2-76*a* against the applied force. By furthermore sliding the stapling unit 2-70 to the upstream side in the sheet feeding direction from this state, as shown in FIG. 20(*a*), the hook 2-76 climbs over a top 2-66*b* of the engaging groove 2-66, and engages in the engaging groove 2-66. The stapling unit 2-70 is thereby fixed to the punching unit 2-60, and disabled to move to the downstream side in the sheet feeding direction. In addition, an engaging groove may be provided in the stapling unit 2-70, while a hook may be provided in the punching unit 2-60.

Figure 15:
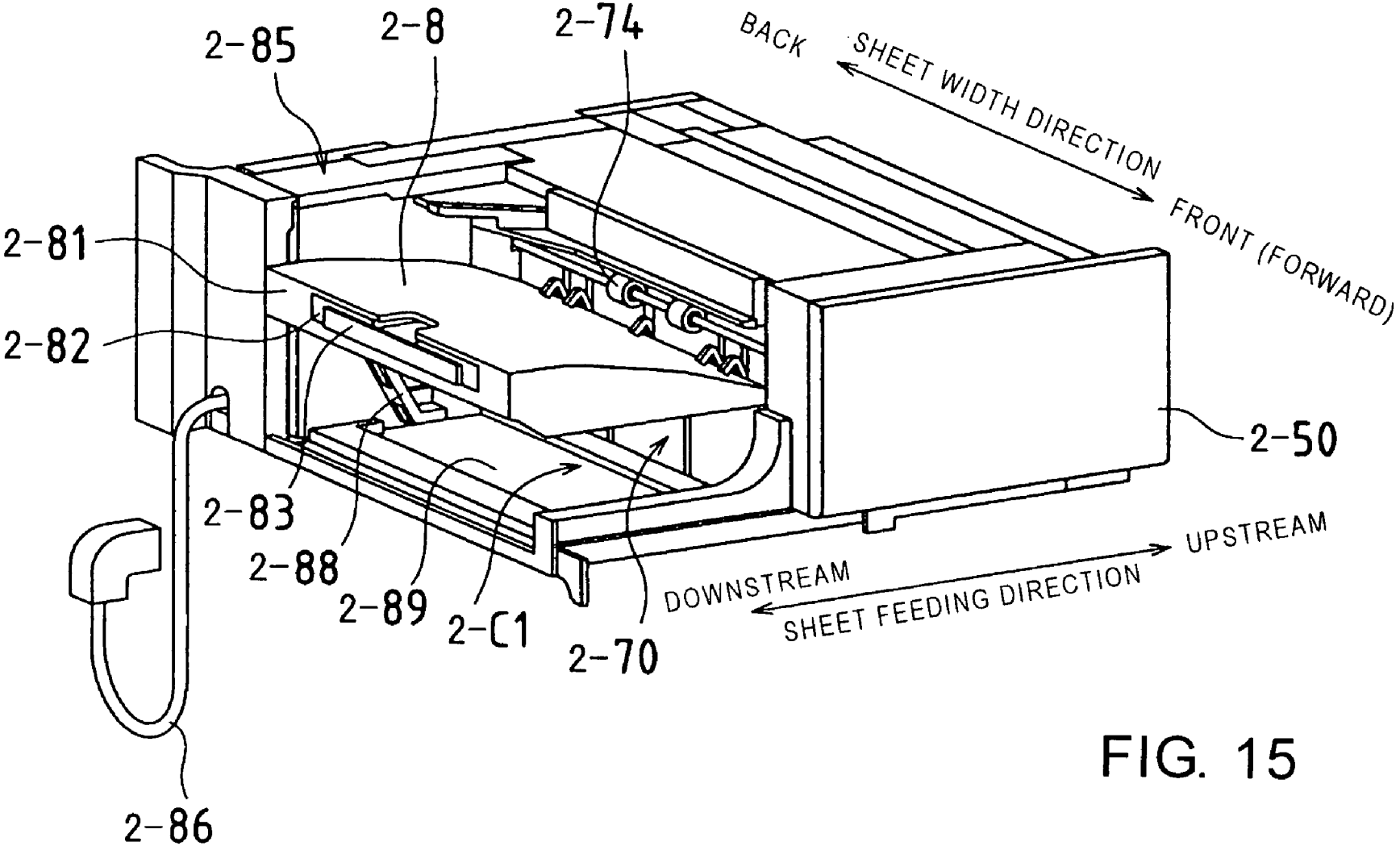
FIG. 15 is a perspective view showing the sheet post-processing section and output tray where the output tray shrinks and moves upward and a cover is closed.
Figure 16:
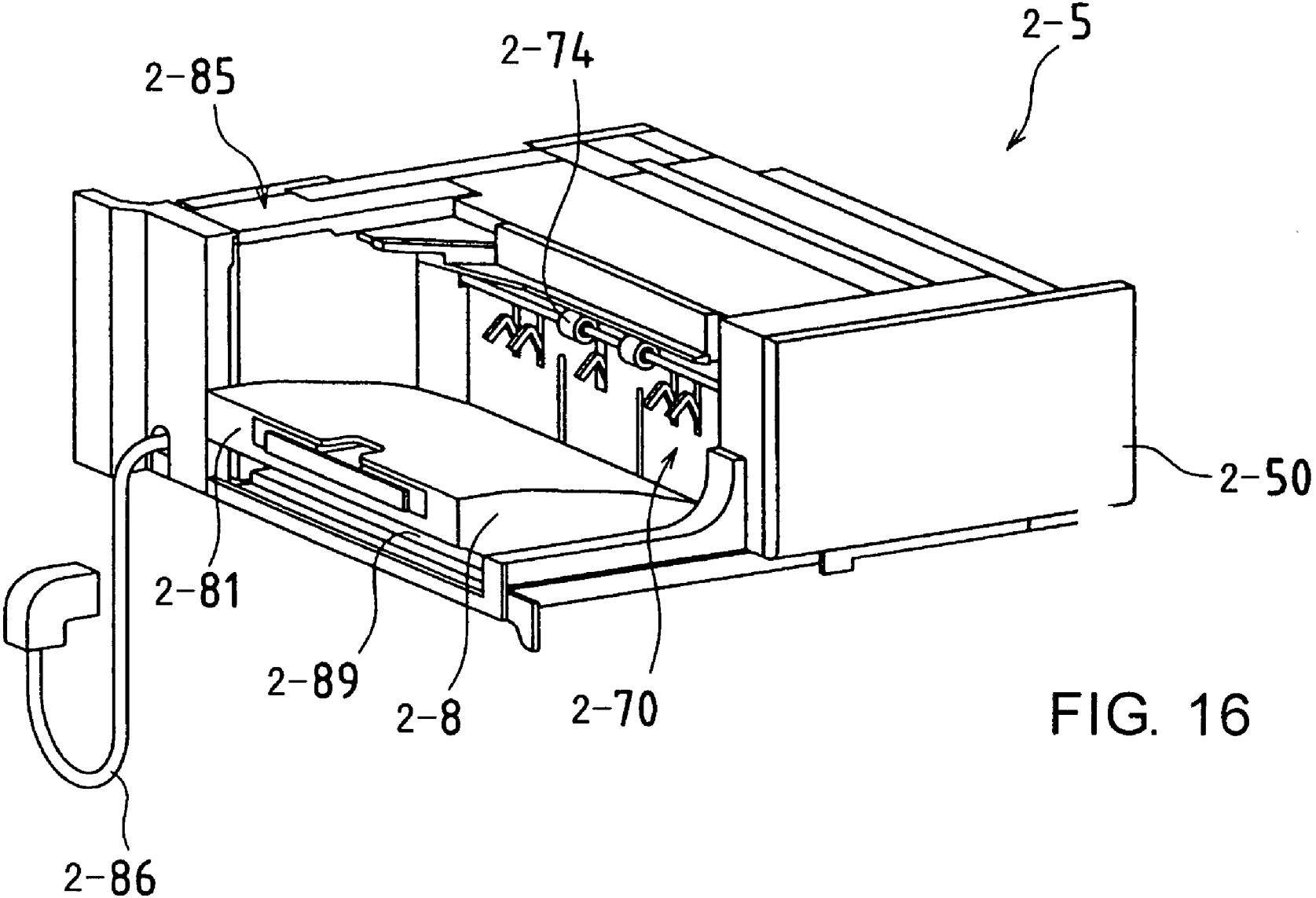
FIG. 16 is a perspective view showing a state with the output tray moved downward.
Figure 17:
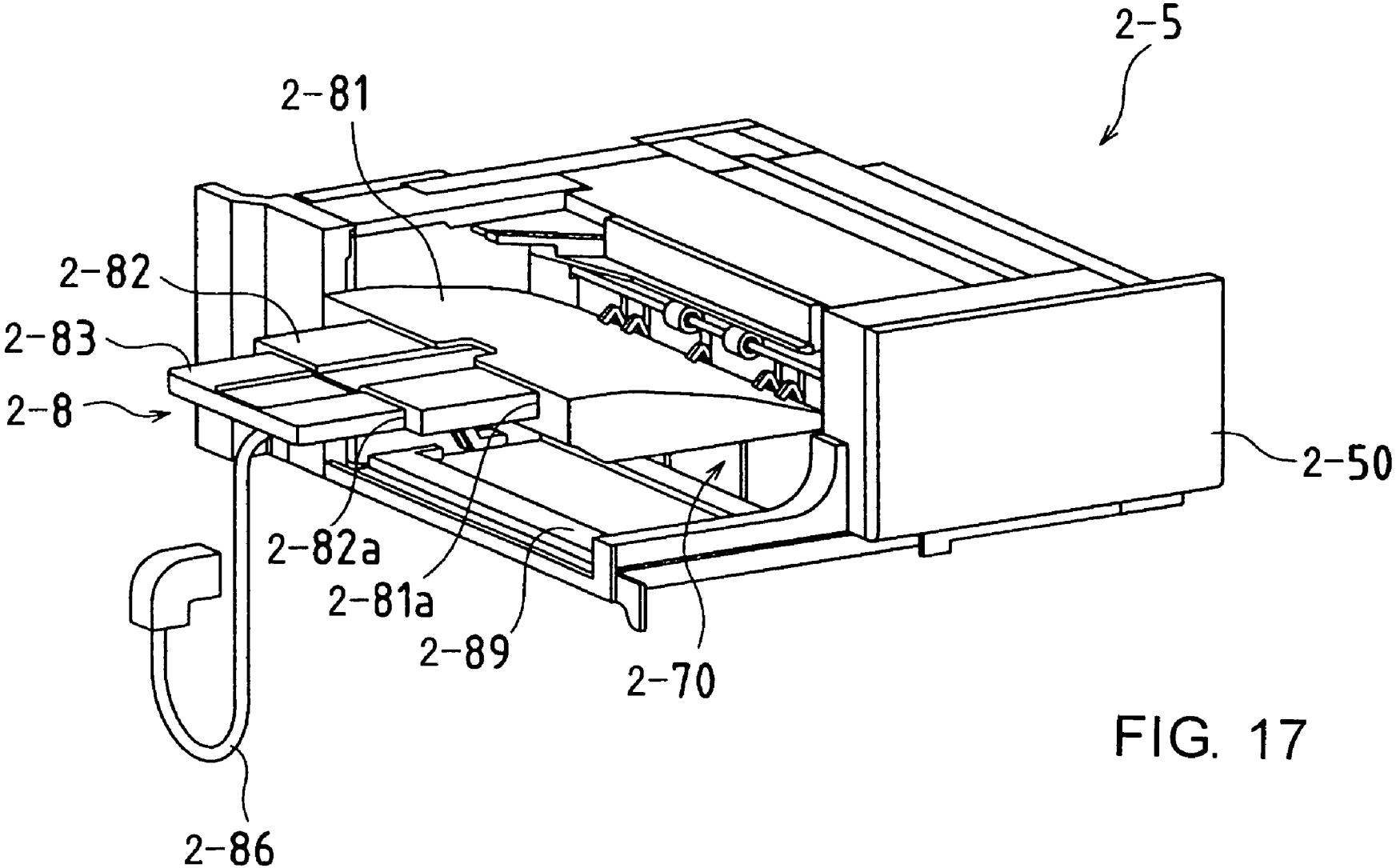
FIG. 17 is a perspective view showing a state with the output tray expanded.
Figure 18:
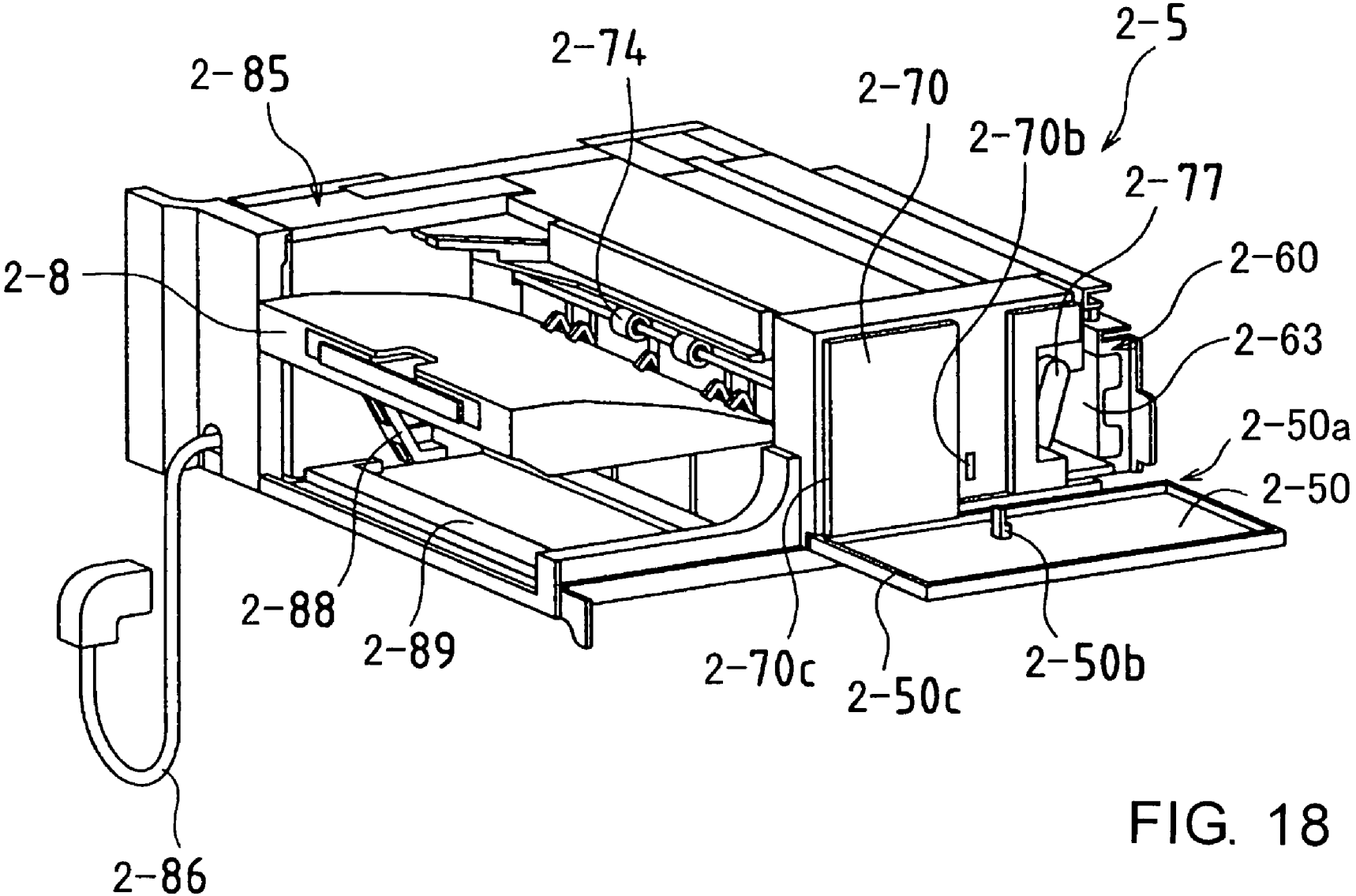
FIG. 18 is a perspective view showing a state with the cover opened.

As described above, the cover 2-50 is provided to be openable/closable in the face on the front side of the sheet post-processing section 2-5. The cover 2-50 is rotatable about a rotation axis 2-50*a* provided at the lower end portion. As shown in FIGS. 15 to 17, when the cover 2-50 is closed, the cover 2-50 is configured to be vertical to cover the face on the front side of the sheet post-processing section 2-5. Contrarily, as shown in FIGS. 18 and 19, when the cover 2-50 is opened, the cover is configured to be substantially horizontal to release the front side of the sheet post-processing section 2-5. By thus opening the cover 2-50, it is possible to remove the punch dust storage box 2-63 toward the front, and dispose of the punch dust inside the punch dust storage box 2-63.

The cover 2-50 is formed in the shape of a rectangle on the front side in size such that the cover is capable of covering all over the faces on the front side of the punching unit 2-60 and stapling unit 2-70. Formed in the cover 2-50 is a protrusion 2-50*b* protruding toward the back (inward of the sheet post-processing section 2-50). When the cover 2-50 is closed, the protrusion 2-50*b* engages in an engaging hole portion 2-70*b* formed in the stapling unit 2-70, and the cover is thereby fixed to the sheet post-processing section 2-5. Further, a protrusion protruding toward the back is formed in the outer edge of the cover 2-50, and when the cover 2-50 is closed, comes into contact with end portions on the front side of the punching unit 2-60 and stapling unit 2-70. Of the protrusions, the protrusion 2-50*c* formed at the end portion on the stapling unit 2-70 side is provided as a regulating protrusion to regulate the position of the stapling unit 2-70.

Figure 21:
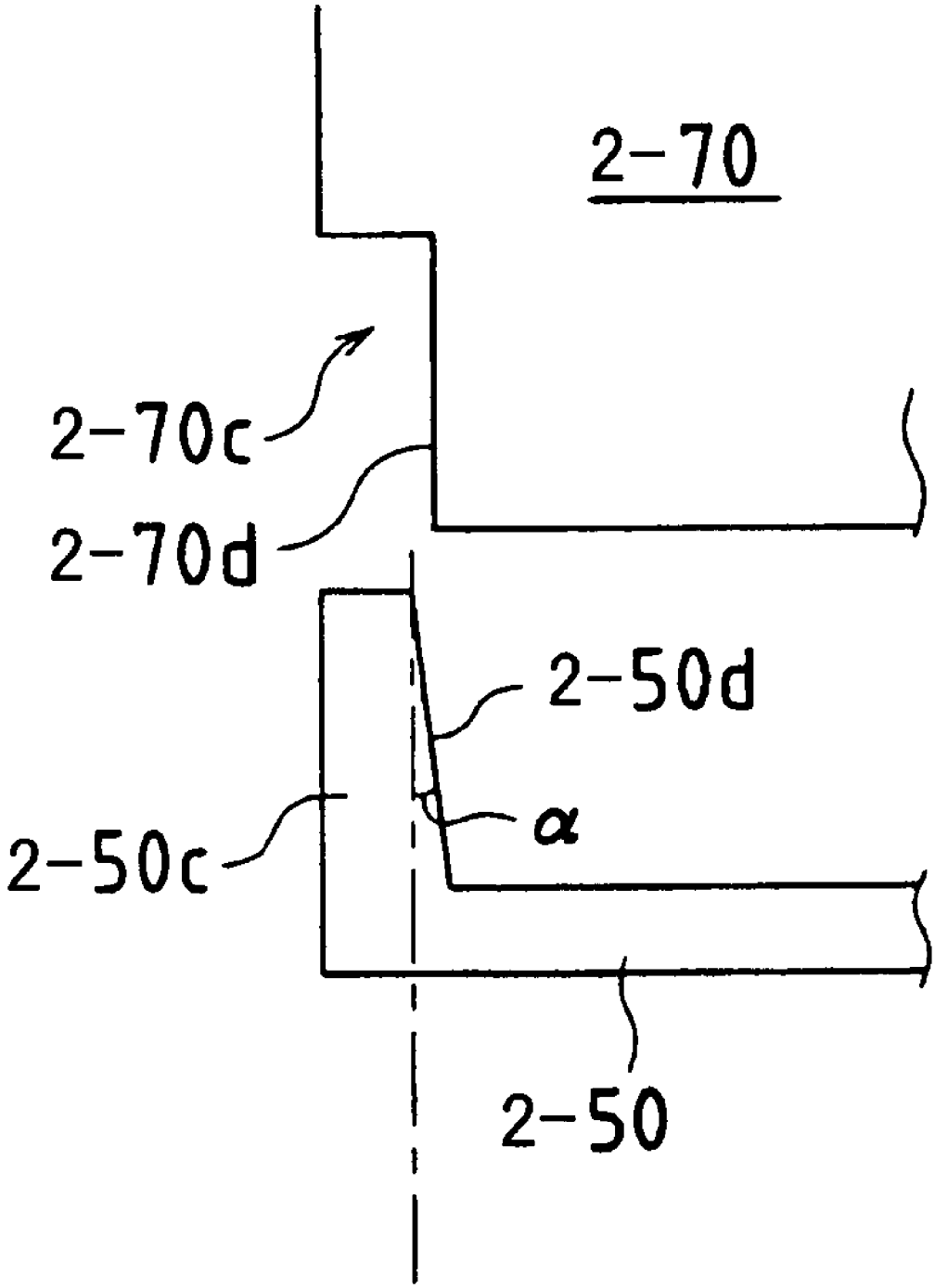
FIG. 21 is an explanatory view illustrating contact of a regulating protrusion of the cover and a regulating groove of the stapling unit.

The regulating protrusion 2-50*c* comes into contact with a regulating groove portion 2-70*c* formed at the end portion on the upstream side in the sheet feeding direction of the face on the front side of the stapling unit 2-70. As shown in FIG. 21, in plan view, in the regulating protrusion 2-50*c*, a contact face 2-50*d* to contact the regulating groove portion 2-70*c* is not formed in parallel with the direction along the sheet width direction (shown by alternate long and short dashed lines in FIG. 21), and is inclined angle $\alpha$ toward the direction along the sheet width direction. Thus, the width in the direction along the sheet feeding direction of the regulating protrusion 2-50*c* is formed to taper toward the front end (toward the inner side of the post-processing section 2-5). Meanwhile, a contact face 2-70*d* on the regulating groove portion 2-70*c* side of the stapling unit 2-70 is formed in parallel with the direction along the sheet width direction, in plan view.

Following merits are obtained by providing the cover 2-50 with the aforementioned regulating protrusion 2-50*c*. As described above, the stapling unit 2-70 is configured to enable engagement and disengagement with respect to the punching unit 2-60. Then, the stapling unit 2-70 is fixed to the punching unit 2-60 by the hook 2-76 of the stapling unit 2-70 engaging in the engaging groove 2-66 of the punching unit 2-60. At this point, respective boundary faces 2-60*f* and 2-70*f* are opposed to each other. However, the front end portion 2-76*b* of the hook 2-76 climbs over the top 2-66*b* of the engaging groove 2-66 to engage the hook 2-76 in the engaging groove 2-66, and therefore, a gap is generated between the respective boundary faces 2-60*f* and 2-70*f*.

In this example, the stapling unit 2-70 is slid to the upstream side in the sheet feeding direction to engage the hook 2-76 in the engaging groove portion 2-66 and thus fixed, and then, the cover 2-50 is closed. In this case, in rotating the cover 2-50 to close, the regulating protrusion 2-50*c* of the cover 2-50 comes into contact with the regulating groove portion 2-70*c* of the stapling unit 2-70. When the cover 2-50 is further closed, a contact position of the regulating protrusion 2-50*c* and regulating groove portion 2-70*c* moves frontward gradually along the slope of the contact face 2-50*d* of the regulating protrusion 2-50*c*. The stapling unit 2-70 is thereby pressed against the punching unit 2-60 side. Then, when the protrusion 2-50*b* is engaged in the engaging hole portion 2-70*b* and the cover 2-50 is completely closed, the boundary face 2-70*f* of the stapling unit 2-70 moves close to the boundary face 2-60*f* of the punching unit 2-60 at a position substantially without clearance, and the stapling unit 2-70 is fixed in this sate.

By thus providing the regulating protrusion 2-50*c* that comes into contact with the end portion of the stapling unit 2-70 when the cover 2-50 is closed, it is possible to minimize as possible the clearance generated between the stapling unit 2-70 and punching unit 2-60 when the cover 2-50 is closed. It is thereby possible to regulate a fix position of the stapling unit 2-70, and to prevent the stapling unit 2-70 from vibrating.

Further, the cover 2-50 is configured to serve as a switch to switch between ON/OFF of the operation of the image formation apparatus 2-1. The operation of the image formation apparatus 2-1 includes the operation of each section of the image formation apparatus 2-1 such as the printing processing, sheet post-processing and the like. When the cover 2-50 is closed, the operation of the image formation apparatus 2-1 becomes ON, and various processing is permitted and enabled such as the printing processing, sheet post-processing and the like. Inversely, when the cover 2-50 is opened, the operation of the image formation apparatus 2-1 becomes OFF, and various processing is prohibited and disabled such as the printing processing, sheet post-processing and the like. Thus, according to open and close of the cover 2-50, the operation of the image formation apparatus 2-1 is switched between ON and OFF. Further, in requesting the printing, when the cover 2-50 is opened, it is designed to urge a user to close the cover 2-50.

By providing the sheet post-processing section 5 with the cover 2-50 thus serving as an ON/OFF switch, it is intended to prevent the printing processing, sheet post-processing and the like to be performed with the cover 2-50 opened, for example, in the case of performing the jam handling operation, staple exchange/refill operation or the like. It is thereby possible to guarantee the safety of the image formation apparatus 2-1 provided with the sheet post-processing section 2-5.

In addition, the image formation apparatus 2-1 is provided with another door to open and close, as well as the cover 2-50. Accordingly, the operation of the image formation apparatus 2-1 may be ON with the doors including the cover 2-50 of the image formation apparatus 2-1 all closed, while the operation of the image formation apparatus 2-1 may be OFF with one of the doors including the cover 2-50 of the image formation apparatus 2-1 opened.

The ejection rollers 2-74 are disposed as a pair of upper and lower rollers at the most downstream side in the sheet feeding direction to border the output tray 2-8, and eject recording sheets on the stapling bench 2-72 to the output tray 2-8. The ejection rollers 2-74 are also used as shifter rollers to sort and eject the recording sheets to the output tray 2-8. The upper and lower ejection rollers 2-74 are provided both as driving rollers. In other words, the upper and lower ejection rollers 2-74 are both coupled to a driving source.

Further, the upper and lower ejection rollers 2-74 are provided to enable contact and separation with/from each other, and one (upper roller in this case) of the ejection rollers 2-74 is configured to be movable upward and downward relative to the other one (lower roller) of the ejection rollers 2-74. When recording sheets are ejected to the output tray 2-8, the upper and lower ejection rollers 2-74 are brought into press-contact with each other. Meanwhile, when the stapling processing is performed on recording sheets, the upper and lower ejection rollers 2-74 are spaced apart from each other. In addition, home positions of the upper and lower ejection rollers 2-74 are positions such that the rollers come into press-contact with each other.

Described herein is the shifter processing by the ejection rollers 2-74. In this example, the ejection rollers 2-74 perform the shifter processing on recording sheets, and thereby sort the recording sheets to eject to the output tray 2-8.

The shifter processing is to eject recording sheets to the output tray 2-8 from a plurality of positions along the sheet width direction, and thereby sort the recording sheets while shifting ejection positions of the recording sheets on the output tray 2-8 in the direction along the sheet width direction. Such shifter processing is allowed, for example, by providing the upper and lower ejection rollers 2-74 to be able to reciprocate in the axis direction (the direction along the sheet width direction). More specifically, the upper and lower ejection rollers 2-74 are moved in the axis direction while pinching recording sheets. The recording sheets pinched by the upper and lower ejection rollers 2-74 thus move along the sheet width direction. Then, when the rollers eject the recoding sheet to the output tray 2-8 at this position, it is possible to shift an ejection position of the recording sheets on the output tray 2-8 in the direction along the sheet width direction. Thus, for example, it is possible to sort recording sheets according to the number of copies, and to prevent a final page of the first copy and a first page of the second copy from being ejected at the same position on the output tray 2-8. Further, by sharing the upper and lower ejection rollers 2-74 as shifter rollers, it is possible to reduce the number of parts, cost and like. In addition, after ejecting the recording sheets, the upper and lower ejection rollers 2-74 are returned to the original positions.

The output tray 2-8 is provided in the inner U-shaped space 2-C formed by the apparatus body of the image formation apparatus 2-1, together with the sheet post-processing section 2-5. To the output tray 2-8 is ejected recording sheets subjected to the sheet post-processing such as the punching processing, stapling processing and the like in the sheet post-processing section 2-5. The output tray 2-8 is configured to be extendable along the sheet feeding direction (ejection direction of recording sheets), further to be movable upward and downward, and furthermore, to be slidable relative to the apparatus body.

As shown in FIGS. 15 to 17, the output tray 2-8 is formed as a tray extendable to first to three stages in the direction along the sheet feeding direction. In this example, the output tray 2-8 is configured to be extendable along the sheet feeding direction by manual operation of a user corresponding to the printed sheet size.

Further, as shown in FIGS. 15 and 16, the output tray 2-8 is formed as a tray movable upward and downward. In this example, the output tray 2-8 is configured to move upward/downward corresponding to an amount (number) of recording sheets to be mounted.

The amount of recording sheets ejected to the output tray 2-8 is detected by an upper limit sensor 2-84 provided in the vicinity of the lower ejection roller 2-74. The upper limit sensor 2-84 is provided as a contact type sensor. Then, when the surface of the highest recording sheet mounted on the output tray 2-8 reaches a predetermined height, the upper limit sensor 2-84 becomes ON. It is thus detected that the output tray 2-8 is full. Then, the output tray 2-8 is moved downward by a predetermined distance by detection of full sheets. The downward movement of the output tray 2-8 switches the upper limit sensor 2-84 to OFF. Thus, the upper limit sensor 2-84 is switched between ON/OFF, and the amount of recording sheets mounted on the output tray 2-8 is thereby detected. In this example, a home position of the output tray 2-8 is the highest rising position (position as shown in FIG. 15) of the output tray 2-8, where an upstream-side end portion of the output tray 2-8 is located immediately under the ejection rollers 2-74. Then, as the amount of mounted recording sheets increases, the output tray 2-8 is moved downward gradually. In addition, the upper limit sensor 2-84 may be comprised of an optical sensor.

As described above, the output tray 2-8 is provided to be extendable, and configured such that in its upward/downward travel, moving the first output tray 2-81 upward/downward also moves a second output tray 2-82 and third output tray 2-83 upward/downward together with the first output tray 2-81.

Up and down of the first output tray 2-8 is carried out as described below, for example. Provided at the back of the first output tray 2-81 is a driving section 2-85 to move the first output tray 2-81 upward/downward. The driving section 2-85 stores a driving belt (not shown), and the driving belt can be driven by a driving power supply not shown connected by wiring 2-86. To the driving section 2-85 is coupled a support member that supports a front end portion of the first output tray 2-81. The support member is provided to perform reciprocating travel upward and downward by driving the driving belt. Then, via such a support member, the power of the driving belt of the driving section 2-85 is conveyed to the first output tray 2-81, and the first output tray 2-81 thus travels upward and downward. Further, under the first output tray 2-81 is provided an arm 2-88 that supports the first output tray 2-81. The arm 2-88 is disposed between the first output tray 2-81 and bottom 2-89. The arm 2-88 is provided while being bent in the shape of an "L", and the bending angle is variable. The bending angle of the arm 2-88 varies according to an upward/downward position of the first output tray 2-81. In addition, a protrusion is provided at an end portion closer to the sheet post-processing apparatus 2-5 of the first output tray 2-81. The protrusion engages in a groove portion, vertically extending for a long distance, provided in the sheet post-processing section 2-5, and is slidable inside the groove portion.

Figure 22:
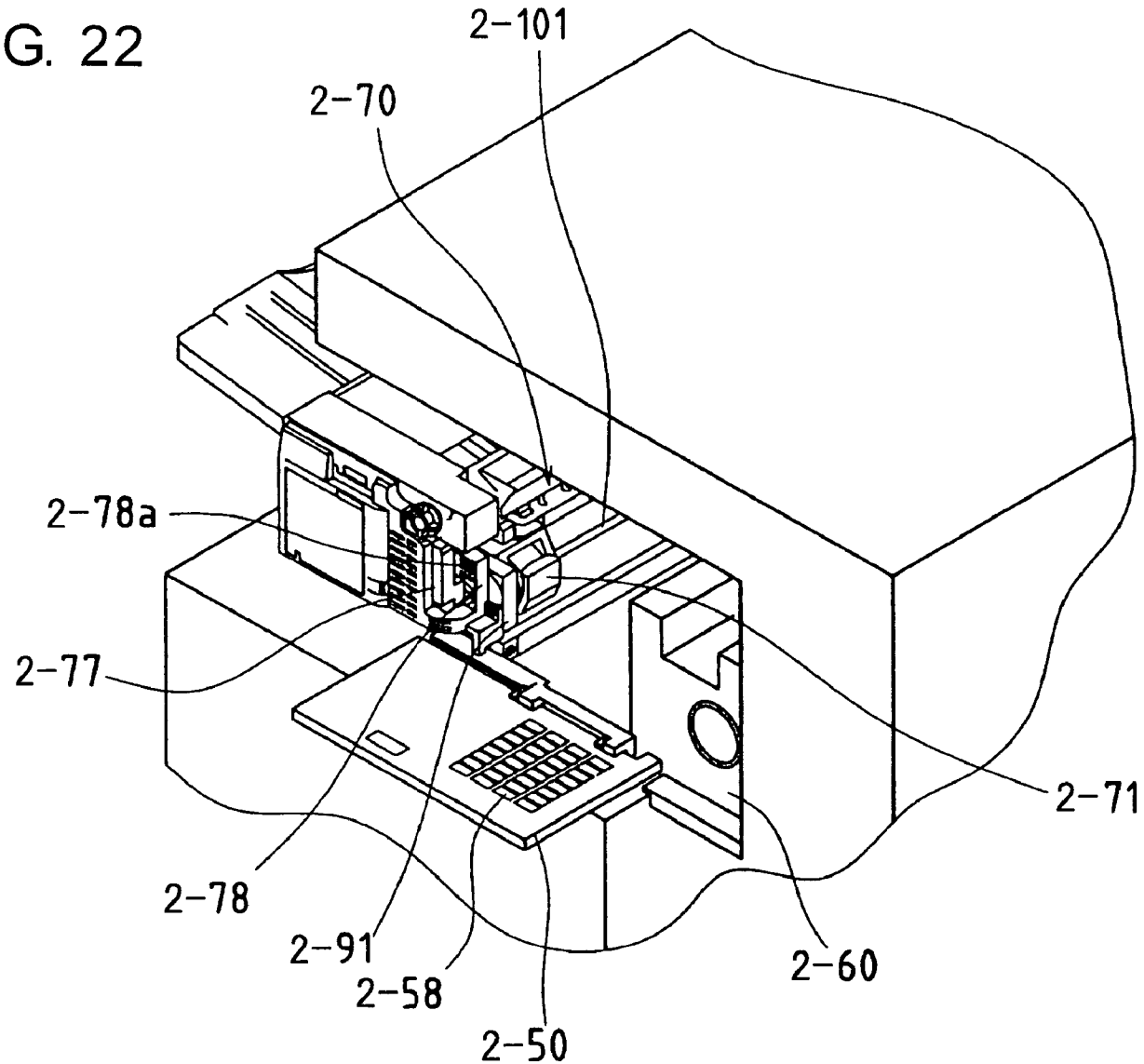
FIG. 22 is a perspective view showing a state where the stapling unit slides downstream along the sheet feeding direction with the cover opened.
Figure 23:
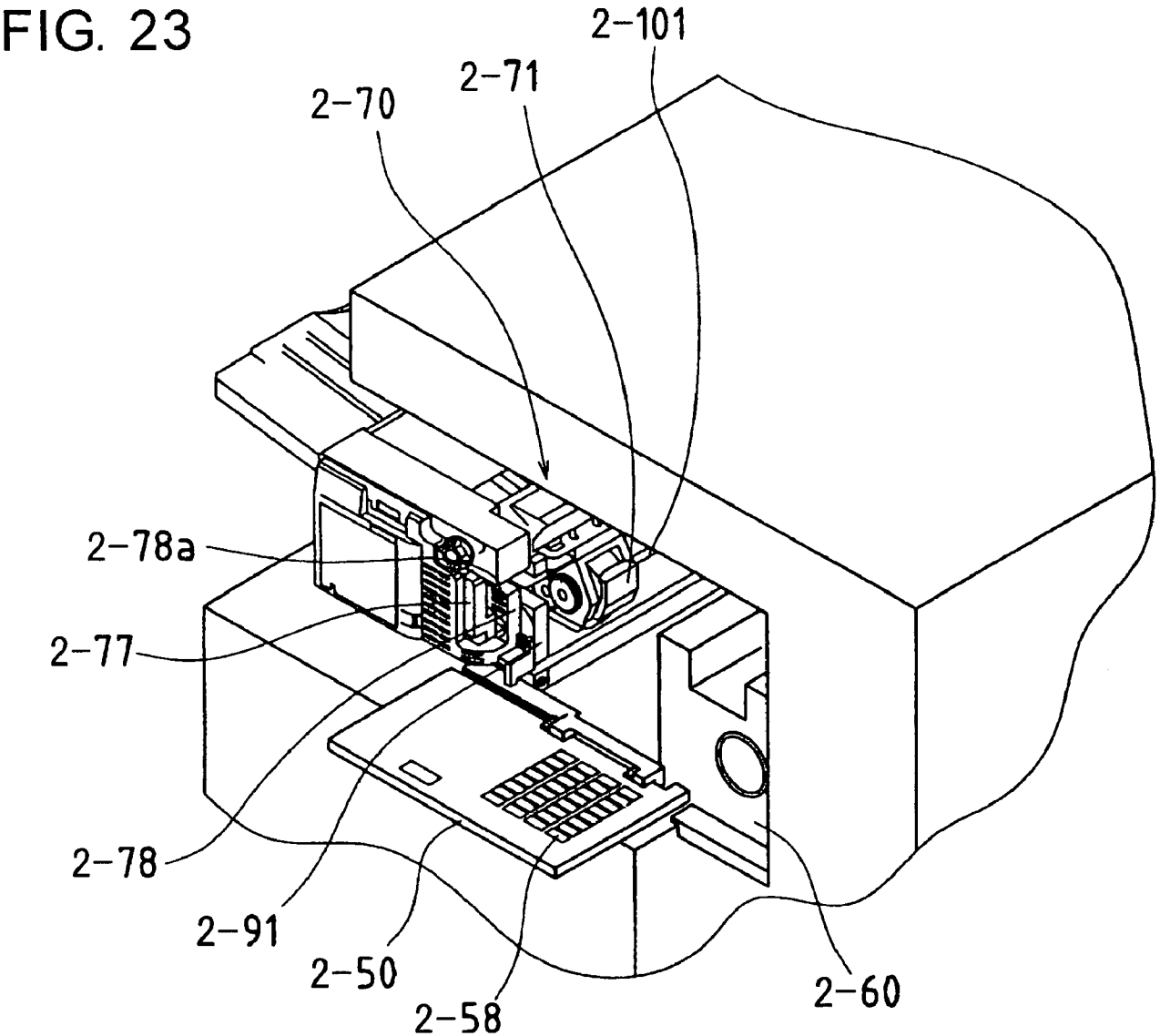
FIG. 23 is another perspective view showing the state where the stapling unit slides downstream along the sheet feeding direction with the cover opened.
Figure 24:
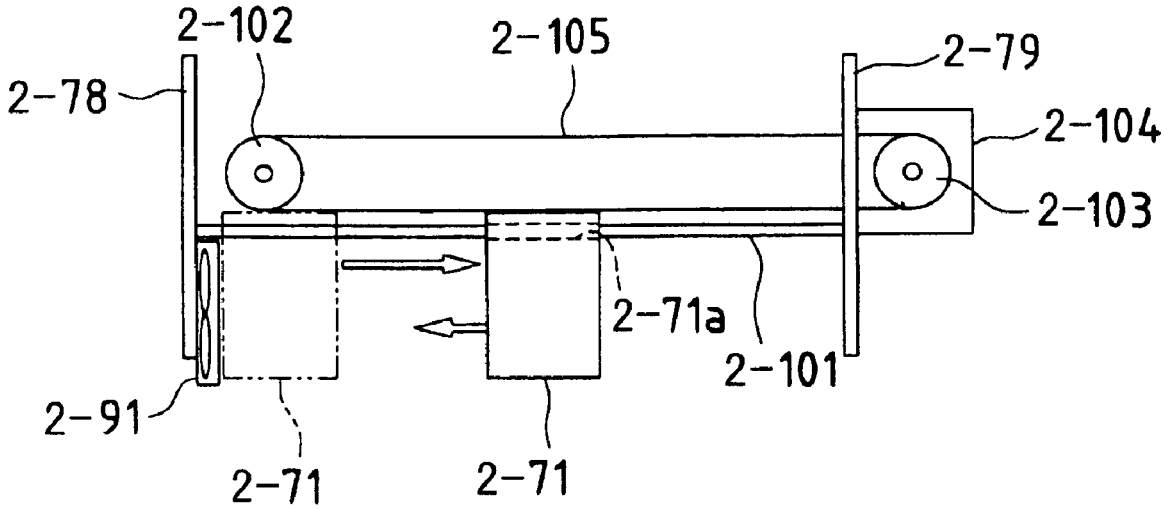
FIG. 24 is an explanatory view schematically showing a driving system of a stapling mechanism section.

FIGS. 22 and 23 are perspective views showing a state where the stapling unit 2-70 is slid to the downstream side along the sheet feeding direction with the cover 2-50 opened, as viewed from a slightly different angle from the angle in FIG. 19. Further, FIG. 24 is an explanatory view schematically showing a driving system of the stapling mechanism section 2-71, where the stapling unit 2-70 is viewed from the upstream side in the sheet feeding direction.

In the sheet post-processing section 2-5 according to the invention, the cover 2-50 is provided with air vents 2-51. Further, on the front side of the stapling unit 2-70, the lock release lever 2-77 is provided in a front frame 2-78 with an air vent 2-78*a* formed therein, and a cooling fan 2-91 is provided at the back of the front frame 2-78 that is an inverse side to the lock release lever 2-77. The cooling fan 2-91 is disposed to form air paths from the front toward the back of the stapling unit 2-70 (i.e. toward the sheet width direction perpendicular to the sheet feeding direction). Then, the stapling mechanism section (stapler) 2-71 is disposed adjacent at the back of the stapling unit 2-70 on the air path of the cooling fan 2-91.

The stapling mechanism section 2-71 is provided to enable reciprocating travel in the sheet width direction in the stapling unit 2-70. In other words, as shown in FIG. 24, a slide rail 2-101 is disposed between the front frame 2-78 and a rear frame 2-79 of the stapling mechanism section 2-71, horizontally along the sheet width direction, and the stapling mechanism section 2-71 can perform precipitating travel in the sheet width along the slide rail 2-101. In other words, the slide rail 2-101 is passed through a though hole 2-71*a* formed in the stapling mechanism section 2-71.

Meanwhile, a following roller 2-102 is disposed at a position above and near the slide rail 2-101, closer to the front frame 2-78. A driving roller 2-103 coupled to a driving motor 2-104 is disposed at the back of the rear frame 2-79. An endless driving belt 2-105 is wound around the driving roller 2-103 and following roller 2-102. Part of the driving belt 2-105 is fixed to the upper face of the stapling mechanism section 2-71. In this way, the stapling mechanism section 2-71 can perform reciprocating travel between the front frame 2-78 and rear frame 2-79 along the sheet width direction by right revolving control and left revolving control of the driving motor 2-104.

The stapling mechanism section 2-71 with such a structure waits in the vicinity of the cooling fan 2-91 on the front side of the stapling unit 2-70, as shown by dashed lines in FIGS. 22 and 24, at the standby time. It is thus possible to perform exchange or refill of staples with ease as in conventional cases.

Meanwhile, at the operation time of the cooling fan 2-91, the section 2-71 travels toward the back of the stapling unit 2-70 as shown in FIG. 23, and stops at a nearly center position between the front frame 2-78 and rear frame 2-79 as shown by solid line in FIG. 24. By this means, sufficient space i.e. air path is guaranteed between the cooling fan 2-91 and stapling mechanism section 2-71, and it is thereby possible to flow the air to a circuit board not shown and the like disposed at the back of the sheet post-processing section 2-5. Then, at the stapling processing time, the section 2-71 travels to a predetermined stapling position to execute the stapling processing.

Figure 25:
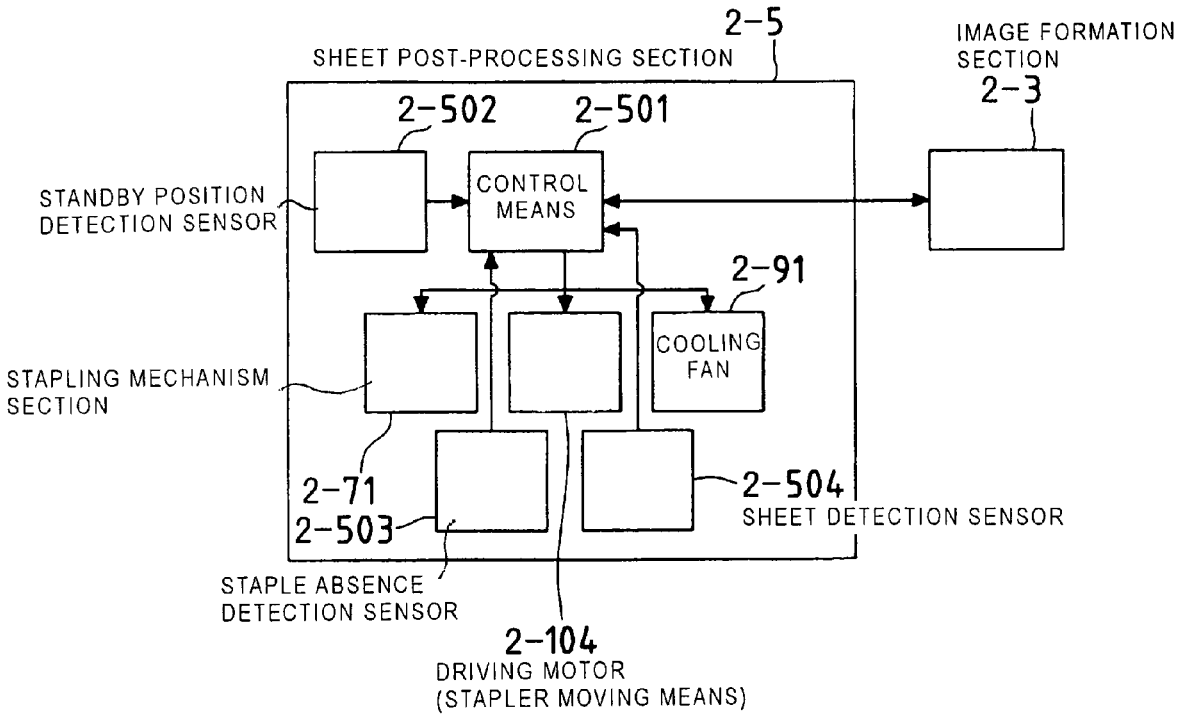
FIG. 25 is a functional block diagram illustrating a control system of the sheet post-processing apparatus.

FIG. 25 is a functional block diagram illustrating a control system of the sheet post-processing section 2-5 with the above-mentioned structure.

The image formation section 2-3 and sheet post-processing section 2-5 of the image formation apparatus 2-1 communicate with each other to cooperate. The sheet post-processing section 2-5 is provided with control means 2-501 for controlling the sheet post-processing section 2-5, the stapling mechanism section 2-71 that performs the stapling processing on recording sheets corresponding to a single copy mounted on the stapling bench 2-72, a standby position detection sensor 2-502 that detects whether or not the stapling mechanism section 2-71 is located in a standby position (home position), the driving motor 2-104 that is stapler moving means for moving the stapling mechanism section 2-71 to reciprocate in the sheet width direction, the cooling fan 2-91 provided on the front of the stapling unit 2-70, a staple absence detection sensor 2-503 that detects that staples filled in the stapling mechanism section 2-71 run out, and a sheet detection sensor 2-504 that detects a recoding sheet on the main feeding path 2-51 in the sheet post-processing section 2-5.

Figure 26:
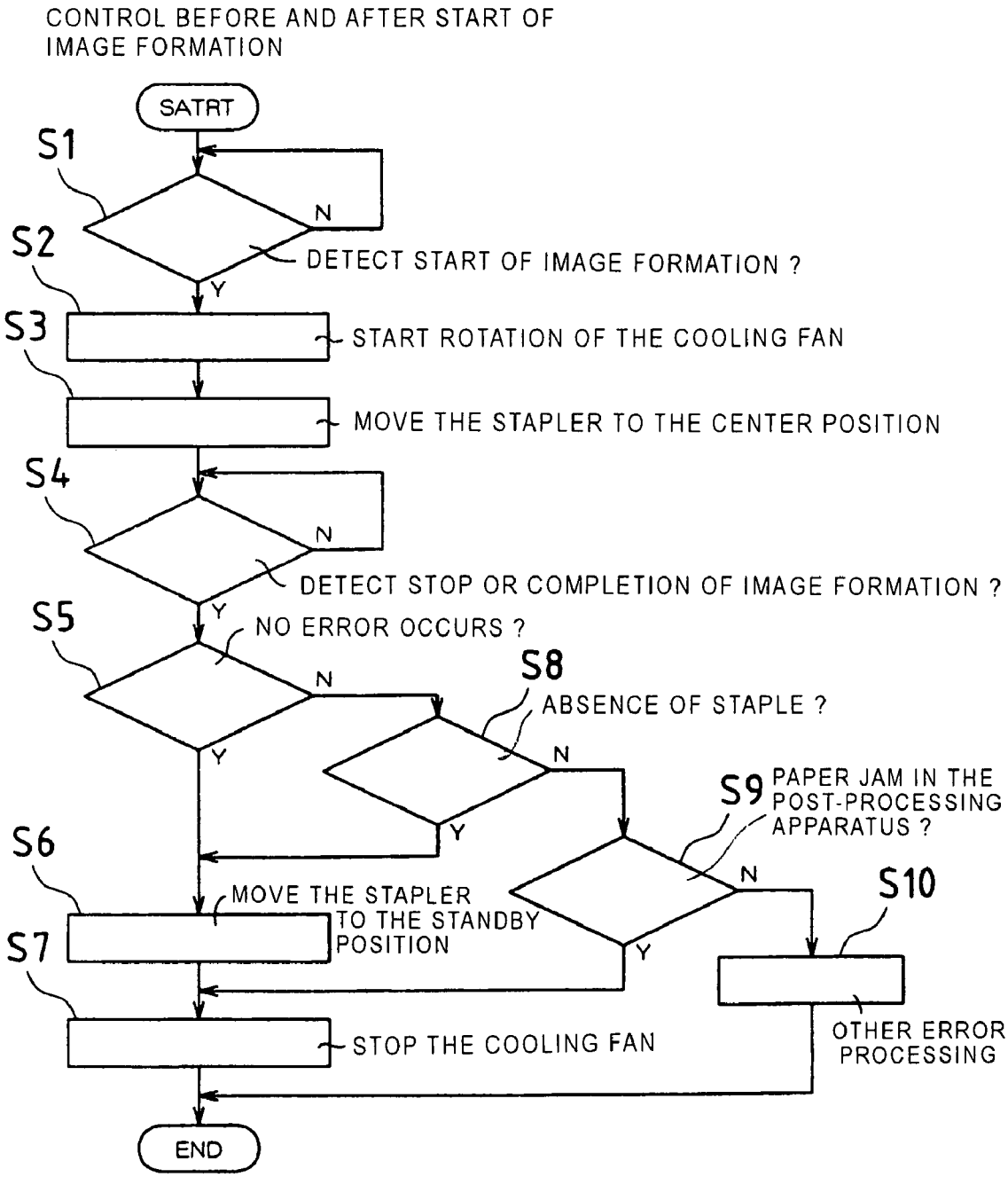
FIG. 26 is a flowchart illustrating the processing operation of the sheet post-processing apparatus in image formation.
Figure 27:
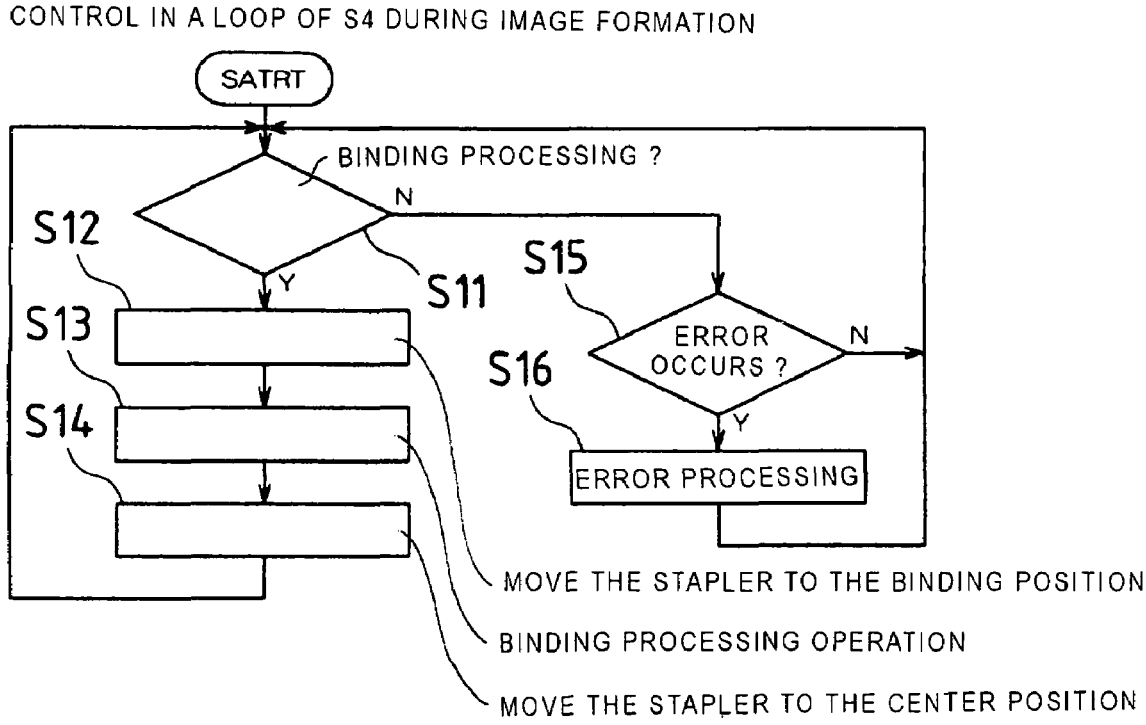
FIG. 27 is another flowchart illustrating the processing operation of the sheet post-processing apparatus in image formation.

Described next is the processing operation of the sheet post-processing section 2-5 in image formation in the image formation apparatus 2-1 with the above-mentioned structure, with reference to flowcharts as shown in FIGS. 26 and 27. In addition, in FIGS. 26 and 27, the stapling mechanism section 2-71 is referred to as a stapler.

In a standby state before starting image formation, the cooling fan 2-91 stops rotation, and the stapling mechanism section 2-71 waits at the standby position (home position) nearby the cooling fan 2-91. In this state, when an instruction to start printing (start image formation) is input from an operation panel of the apparatus body, external personal computer or the like, not shown ("Yes" is judged in step S1), the control means 2-501 drives the cooling fan 2-91 to start rotating the fan (step S2), drives the driving motor 2-104 to move the stapling mechanism section 2-71 toward the back of the stapling unit 2-70, and stops the section 2-72 at the nearly center position between the front frame 2-78 and back frame 2-79 (step S3). By this means, adequate space is formed between the cooling fan 2-91 and stapling mechanism section 2-71, and air paths for cooling are reserved inside the stapling unit 2-70.

Thereafter, whether or not the image formation operation (printing operation) is completed is monitored (step S4). When the image formation operation is completed ("Yes" is judged in step S4), checked next is whether or not an error occurs in the sheet post-processing section 2-5 (step S5). When the operation is completed without error ("Yes" is judged in step S5), the stapling mechanism section 2-71 stopping at the center position is moved toward the frond side of the stapling unit 2-70, and stopped at the standby position (home position) (step S6). Further, rotation of the cooling fan 2-91 is stopped (step S7).

Meanwhile, when an error occurs in the sheet post-processing section 2-5 ("No" is judged) in step S5, it is checked whether or not the error is caused by the absence of staple in the stapling mechanism section 2-71, using a sensor output of the staple absence detection sensor 2-503 (step S8). As a result, when the error is caused by the absence of staple ("Yes" is judged in step S8), the operation proceeds to step S6, and the stapling mechanism section 2-71 stopping at the center position is moved toward the front side of the stapling unit 2-70 and stopped at the standby position (home position). It is thereby possible to exchange or refill staples smoothly when the error is caused by the absence of staple.

When the error is not caused by the absence of staple ("No" is judged in step S8), it is checked whether or not a paper jam occurs in the sheet post-processing section 2-5, using a sensor output of the sheet detection sensor 2-504 (step S9). As a result, in the case of the paper jam (when "Yes" is judged in step S9), the operation proceeds to step S7 with the stapling mechanism section 2-71 stopped at the center position, and rotation of the cooling fan 2-91 is stopped. By this means, in the case of the paper jam, it is possible to prevent occurrences of inconvenience such that the stapling mechanism section 2-71 is further moved, and the paper jam thereby becomes worse.

Meanwhile, when the error is not caused by the absence of staple or by paper jam in the sheet post-processing section 2-5 ("No" is judged in step S9), other error processing is executed in response to the error (step S10).

In the aforementioned processing (steps S1 to S10), when the printing start instruction includes the stapling processing, during the step for monitoring whether the image formation operation is completed or not, executed is the stapling processing of the flowchart as shown in FIG. 27.

In other words, it is monitored whether the stapling processing (binding processing) is executed or not (step S11), while it is monitored whether an error occurs or not during the monitoring (step S15). Then, when an error occurs ("Yes" is judged in step S15), the error processing is executed (step S16). Specifically, the error processing herein is the same as the error processing (steps S6 to S10) after "No" is judged in step S5.

Meanwhile, during the monitoring in step S11, when the stapling processing is allowed to be executed by the stapling bench 2-72 storing recording sheets of one copy ("Yes" is judged in step S11), the stapling mechanism section 2-71 is moved to the stapling position (binding position) from the center position in the feeding width direction where the section 2-71 is stopped (step S12), performs the stapling processing operation (binding processing operation) (step S13), and then, is moved again to the center position in the feeding width direction to be stopped (step S14). During the image formation operation, whenever the stapling processing is executed, the stapling mechanism section 2-71 repeats the above-mentioned processing (steps S11 to S14).

In addition, the stapling mechanism section 2-71 may be moved to the stapling position (binding position) from the center position in the feeding width direction where the section is stopped, prior to completion of the storage of recording sheets of one copy in the stapling bench 2-72. In other words, when the number of recording sheets of one copy is N, the stapling mechanism section may be moved at the time N-m sheets are stored on the stapling bench, and start the binding processing after N sheets are stored on the stapling bench. Thus, the present invention enables the sheet post-processing with high efficiency and high reliability while eliminating wait time due to travel of the stapler.

In the foregoing, the first embodiment (FIGS. 1 to 12) and second embodiment (FIG. 13 to 27) are described specifically of the sheet post-processing apparatus and image formation apparatus provided with the sheet post-processing apparatus according to the present invention. The two above-mentioned embodiments of the invention are the same in the respect that the fan means sends air to the sheet post-processing apparatus incorporated into the image formation apparatus and to sheets in their lateral direction with excellent air passages reserved, and thereby implements effective cooling, but the present invention is not limited to the above-mentioned two embodiments.

What is claimed is:

1. A sheet post-processing apparatus comprising:

an ejection path that successively feeds sheets each with an image formed thereon from an ejection outlet;

a processing tray that is disposed to temporarily store the sheets fed from the ejection path; and a post-processing unit that performs post-processing on the sheets on the processing tray, the post-processing including binding processing, punching processing, or both binding processing and punching processing;

wherein the post-processing unit is located under the ejection path, disposed to move in a sheet lateral direction perpendicular to a sheet feeding direction, and is provided with a cooling fan positioned in the sheet lateral direction from the post-processing unit to send air toward the post-processing unit.

2. The sheet post-processing apparatus according to claim 1, wherein the post-processing unit comprises a stapler that performs binding processing on the sheets on the processing tray, a guide member that supports the stapler to be movable along a rear end edge of the sheets on the processing tray, and driving means for controlling travel of the stapler along the guide member.

3. The sheet post-processing apparatus according to claim 2, wherein the driving means controls travel of the stapler to move along the guide member to a position such that the air from the cooling fan is guided to the ejection path, and to a position such that post-processing is performed on the sheets on the processing tray.

4. The sheet post-processing apparatus according to claim 2, wherein the driving means moves the post-processing unit to a position spaced a predetermined distance away from the cooling fan until the sheets are stored in the processing tray, and the post-processing unit causes the air from the cooling fan to change in direction toward the ejection path.

5. The sheet post-processing apparatus according to claim 1, wherein the ejection path is comprised of a plate-shaped guide that guides a sheet, and the plate-shaped guide member has a plurality of air vents in a region where the post-processing unit is disposed.

6. The sheet post-processing apparatus according to claim 5, wherein the driving means controls travel of the stapler to move along the guide member to a position such that the air from the cooling fan is guided to the ejection path, and to a position such that post-processing is performed on the sheets on the processing tray.

7. The sheet post-processing apparatus according to claim 5, wherein the driving means moves the post-processing unit to a position spaced a predetermined distance away from the cooling fan until the sheets are stored in the processing tray, and the post-processing unit causes the air from the cooling fan to change in direction toward the ejection path.

8. The apparatus according to claim 1, in combination with an image formation apparatus body having:

a paper feed section that feeds sheets on a stacker successively;

a printing section that performs predetermined printing on a sheet from the paper feed section;

a fusing section that fuses ink on the sheet fed from the printing section to provide the sheets each having an image thereon; and an ejecting section that comprises said ejection path;

an image reading apparatus that is disposed above the image formation apparatus body and that reads an original image set on a platen;

a post-processing apparatus that is disposed in the processing tray and is attached to the ejecting section of the image formation apparatus body to be detachable and movable in a sheet feeding direction relative to the image formation apparatus body, and that comprises the post-processing unit; and wherein the post-processing unit guides a sheet from the ejecting section to said processing tray, while being configured to travel in a direction perpendicular to the sheet feeding direction.

9. The apparatus according to claim 8, wherein the post-processing unit is disposed under a feeding region of a sheet passing through the ejection path to be movable in a direction perpendicular to the feeding direction, the cooling fan is disposed at a side of the feeding region of the sheet passing through the ejection path, and the post-processing unit causes the air from the cooling fan to change in direction toward a sheet passing region of the ejection path.

10. The apparatus according to claim 8, wherein the post-processing unit comprises a stapler that performs binding processing on sheets on the processing tray, a guide member that supports the stapler to be movable along a rear end edge of the sheets on the processing tray, and driving means for controlling travel of the stapler along the guide member, and the driving means controls travel of the stapler to move along the guide member to a position such that the air from the cooling fan is guided to the ejection path, and to a position such that post-processing is performed on sheets on the processing tray.

* * * * *